US012024877B2

(12) United States Patent
Simonsen

(10) Patent No.: US 12,024,877 B2
(45) Date of Patent: Jul. 2, 2024

(54) INSULATION WIRE MOUNTING SYSTEM

(71) Applicant: David John Simonsen, Redding, CA (US)

(72) Inventor: David John Simonsen, Redding, CA (US)

( * ) Notice: Subject to any disclaimer, the term of this patent is extended or adjusted under 35 U.S.C. 154(b) by 810 days.

(21) Appl. No.: 17/123,094

(22) Filed: Dec. 15, 2020

(65) Prior Publication Data

US 2022/0186489 A1 Jun. 16, 2022

(51) Int. Cl.

| | |
|---|---|
| ***E04B 1/49*** | (2006.01) |
| ***E04B 1/61*** | (2006.01) |
| ***E04B 1/90*** | (2006.01) |
| *E04B 1/38* | (2006.01) |

(52) U.S. Cl.

CPC ..... *E04B 1/49* (2013.01); *E04B 1/61* (2013.01); *E04B 1/90* (2013.01); *E04B 2001/386* (2013.01); *E04B 2001/389* (2023.08)

(58) Field of Classification Search

CPC ..... E04B 1/49; E04B 1/61; E04B 1/90; E04B 2001/386; E04B 2001/389; E04B 1/80; E04B 1/7629; E04B 2001/8263

See application file for complete search history.

(56) References Cited

FOREIGN PATENT DOCUMENTS

| | | | | |
|---|---|---|---|---|
| GB | 2351120 A | * | 12/2000 | ..... E04B 1/944 |
| WO | WO-8402733 A | * | 7/1984 | ..... E04B 1/7629 |

* cited by examiner

*Primary Examiner* — Patrick J Maestri

(57) ABSTRACT

An insulation mounting system utilizing a thermal break consisting of radiused and/or straight channels, slots and holes for the purpose of mounting specially shaped formed wire to hold-in-place rigid insulation installed onto walls of buildings. A structural clip for further positioning, holding, bending and/or directing the same formed wire shapes. A sub-girt that attaches to the structural clips vertically or horizontally as needed, a wire bending tool for use at intermediate formed wire locations between assembled thermal clips, and an anti-reversal clip with bendable attachment arm for holding other building materials if needed. Multiple alternate embodiments for the thermal break, formed wires and structural clips show that there's an almost a limitless amount of variations that a person skilled in the art could imagine and not exceed the scope of the application.

1 Claim, 21 Drawing Sheets

INSULATION WIRE MOUNTING SYSTEM

CROSS REFERENCES RELATED APPLICATIONS

The present application claims the benefit of U.S. Provisional Patent Application Ser. No. 62/948,221 filed Nov. 14, 2019.

BACKGROUND OF THE INVENTION

The present invention relates to novel and useful products and methods for mounting rigid insulation to the exterior of commercial buildings that utilize continuous insulation that will provide for faster and less expensive installation of the insulation, having no penetrations through the weather barrier, and providing attachment options for various different conditions.

In the past, insulation installation systems have been a separate process from sub-girt mounting systems. There are a number of ways that insulation can be installed including friction fitting the insulation batts between girts, screwing them to the wall with a long screws and plastic cap in a pre-designated pattern, gluing pins to the wall that penetrate the insulation and then get a non-reversing cap on the end of the pin to keep the insulation from coming off. Each will hold the weather barrier in place but some options are very expensive and require a lot of materials, some create a potential location for leakage to the building substrate, and they allow thermal transfer from outside of the insulation to the building substrate.

The present invention is an Insulation Wire Mounting System that provides for faster installation of the insulation and requires no penetrations through the wall assembly and weather barrier, which is a notable advance in the field because it also combines thermal dip/sub-girt mounting systems with insulation mounting systems. This eliminates many potential leak points to the building by eliminating the number of penetrations through the weather barrier, provides anti-reversing installation for the insulation, and will provide for less thermal transfer to the building, and reduces vibration (noise) to the building.

Because wire has structural characteristics, and because it can be made with numerous materials that include corrosion resistance and spring-back when bent, it's an inexpensive alternative to screw and pin attachments. Wire is very versatile in the fact that it can be bent to almost any shape, it can be welded and/or twisted together to make extremely difficult shapes, it can be dipped in plastics to help reduce thermal transfer, and ifs light-weight and easy to handle. Shaped sheet metal is an alternative that can be used for this invention.

BRIEF SUMMARY OF THE INVENTION

In accordance with the present application, a novel and useful Insulation Wire Mounting System products and methods of installation are herein provided that include a thermal clip assembly consisting of a thermal break, a structural clip, and various shaped formed wires. There will also be various shaped sub-girts, a wire bending tool and an anti-reversal clip. Because wire can be bent and shaped in almost limitless shapes, and because separate pieces of wire can be welded together, formed together, and inter-connectable to each other, there will be multiple variations of this concept shown and described within the specification and drawings, and numerous more that can be made that a person skilled in the art would consider as easy to understand in making variations to this invention.

The thermal break may be made of plastics that have proper mechanical, chemical, structural, thermal and temperature resistant properties. It may be made using plastic injection molding processes and will have straight and radiused holes and slots for wires to pass through, guide through, and snap into or onto. It will have through holes for mechanical fastener installation and will have built-in "nyloc" types of shelves within these through holes to prevent the mechanical fastener from backing out of the building substrate. It will have voids to minimize the amount of plastic used that may also serve as marketing tools as they will have letters or words promoting the product or company information. It will have numbers next to certain slots and/or holes that determine the radius and/or thickness of the formed wires which may also be based on the thickness of the insulation.

The bottom of the thermal break may be shaped with an outer edge that helps prevent water from getting underneath them at the weather barrier level, which may consist of a slightly concave bottom so that the perimeter is slightly longer to press harder against the weather barrier. With a concave bottom, only one screw may be required to hold the thermal break in it's intended position because it will also not rotate easily due to higher friction in the smaller contact areas. The single screw mounting the thermal break may also partially cover the formed wire to hold it in place, acting in part as a cover plate that doesn't allow the formed wire to be pulled upwards directly, similar to the structural clip when it's installed over the thermal break (examples of where this could be used is in FIG. 12 and FIG. 19. The formed wires may be connected to or mounted from the thermal break in any location and from any direction, or a multiple of them. The thermal break will have a means to mount to the structural clip such as friction fit nubs with beveled ends for easy insertion but difficult to remove once assembled together. The thermal break may have slots, holes and/or channels for other materials to pass through as well such as conduits and/or conductors, pipes, hose, etc. The thermal break will be made of a low thermally conductive material such as Polypropylene and may be produced in a means such as via plastic injection molding.

The formed wire may be made of spring steel, stainless steel, galvanized steel, and/or plastics as a solid or tube shape. When made of metals they may be formed using common 2D and 3D wire bending machines. They may be made using plastic injection molding processes when materials such as plastics. They may be in any shape including segments that are straight, radiused, angled, coiled, bent, overlapped, or other known shapes in order to penetrate the insulation. The wires may be formed in a radius or bent in segments to imitate a radius so that when the wire is impaled into insulation the remainder of the formed wire section follows the same path so that the insulation is not destroyed or deformed as the formed wire passes through it. The formed wire will be installed into the insulation in a manner to not tear it, while at the same time allowing more, or all, of the layers (or depth) of the insulation to be passed through for best holding strength. The formed wire may be of any shape including circular, square, triangular, elliptical, etc. Washers may be used with the wires to help add pressure to the outer insulation layer to keep the insulation pressed against the wall and to help prevent water intrusion along the formed wire.

The formed wire may be mechanically fastened to the thermal breaks, structural clips, sub-girts and other materials via screws, snap fit and/or by dipping to them. They may be partially or fully encased or dipped in plastic to reduce thermal transfer and for corrosion resistance, or simply be made of plastic in order to minimize the amount of thermal transfer to a building's substrate. Any shape may be made to work and be used for the purpose of mounting rigid insulation. These various shapes may be used on, in, through and/or in conjunction with thermal breaks, structural dips, sub-girts, other formed wires whether welded together or not, mounted directly to the substrate with or without any other materials. The formed wires may have anti-reversal barbs attached to or built into them to prevent the insulation, thermal break, structural clip, sub-girt or other material from being separated from it easily. The formed wires may be partially bent, notched or indented for the purpose of determining the wanted bend location during installation. Radiused sections and other shapes, when encased within a slot or hole matching the radius, may help prevent the formed wire from rotating perpendicular to that radius. The formed wires may be attached to a single thermal break and structural clip or to more than one including in sequence for purposes to include preventing thermal bridging, adding structural strength to the thermal clip assemblies, and holding the rigid insulation in place so that it can't move once the formed wires are installed. The formed wire may also be attached to any material with adhesives to hold it's position such as to the substrate directly or into the thermal break. When attached directly to the substrate with adhesives as an example, the wire may be formed to create a base that allows the formed wire to have directional stability similar to as if a plate was welded to the bottom of it to provide that same stability.

The formed wires may attach into the thermal break(s), structural clip(s), sub-girt(s) or other building material as a single piece, in tandem, welded together as a formed wire assembly, or intertwined or otherwise connected together in order to hold rigid insulation in place or serve another structural or architectural purpose.

The formed wires may be used as 'stitches' to connect one piece of insulation to another to prevent movement or eliminate gaps between them. An example is the small pieces of insulation near the jambs on a building so that they can be 'stitched' to a structurally held-in-place piece of insulation and not held structurally itself. This 'stitching' can be used independently or in conjunction with actual structural fastening of the rigid insulation.

The formed wire stitches may be shaped as a "V" with a circular or other coiled spring at the bottom of the "V" to allow the arms of the V to open and close like a spring. At the two ends of the V arms, each will have an additional secondary arms protruding perpendicular to them, however these arms will be angled towards each other but never be permanently joined at their extremities. These secondary angled arms would be inserted as impaling arms into the insulation, and then released so as to help pull the bottom (or inside) of the insulation together as well as the exposed insulation outer surface, with the angle helping to add pressure between the insulation as well as prevent the insulation stitch from coming out of the insulation.

Formed wire may be attached to a building's substrate with or without the use of a thermal break in order to be an intermediate insulation mounting means between thermal clip assemblies that are spaced vertically beyond 24" on center.

Formed wires may be pre-bent and require no additional bending or require minimal bending by hand or by use of a hand tool.

The formed wires with a radius don't need to exit the insulation when inserted into the bottom of the insulation in order for them to work properly, which will also minimize the space occupied on the outer exposed side of the installed insulation.

The Structural Clip may be made of metal such as stainless or galvanized steel. It has a base that closely resembles the size of the length and width of the thermal clip. The structural dip will be provided at various heights to accommodate the various thicknesses of insulation used. The mounting holes in the Structural Clip will match the mounting hole locations in the insulation Mounting Thermal Break so that mechanical fasteners can be placed through both at the same time to fasten them to the wall permanently. The nubs of the thermal break will insert into matching holes to temporarily hold the 2 parts together prior to installation onto a building's substrate. The structural clip may be a thickness such as 16 gauge stainless steel and made with machines such as turret and brake presses. The structural clip may have holes, slots, 'helping hands', gussets, notches, indentations, protrusions, radiused sections and other features for the installation, support and function of mounting the formed wires, sub-girts and thermal break to it. In some applications a formed wire, tube or formed wire assembly may be used as the structural clip. The structural clips may have helping hands and/or other slots built into them at angles so-as to help reduce the amount of thermal transfer towards the substrate of the building. The structural clip has indentations and slots that help hold the formed wire in particular positions for the purpose of bending the formed wire in particular locations as well as to hold the formed wire in specific locations. The formed wire may be held under an arm or downward positioned protrusion and between the rigid insulation, effectively ensuring that the formed wire will not move once installed.

The Sub-girt is a long strip of metal shaped like an angle or J-channel. It will be attached to the structural clip with a screw through a slot on the structural clip in order to temporarily hold it in place so that the Sub-girts can be positioned to create a plumb and level mounting surface when several are aligned to each other, then they will be permanently mechanical fastened to the structural clips for permanent fixing. Z-shaped sub-girts may be mechanically fastened directly to the top horizontal surface of the structural clips that have this feature, and they may be mounted vertically or horizontally. The sub-girts may be made of materials such as galvanized steel and made using machines such as shears and brake presses.

The wire bending tool allows wire that's not bent or partially bent to be bent more, or to remove a bend. It's shaped to fit between two insulation batts that are tightly fitted adjacently to each other in order to mate with the formed wire to bend it. It may be used to bend an entire custom shape in the field if necessary. It's made of a strong material such as steel having 2 handles fit together with a hinge pin so that the handles can rotate to or from each other from the hinged pin location. The handles will have pins that protrude from them in locations that allow for the wire to be fitted into to provide for a proper bend. The pins may be able to be removed and re-positioned in other holes to allow for different bend capabilities. The pins may be threaded for insertion and removal in the handles. There will be at least 3 protruded pins for thicker gauge formed wires. A single handle with only 2 protruded pins may be used to bend a thin formed wire. The wire bending tool is made with machines such as drill presses, lathes, band saws, tap and die equipment, and pressing machines.

An anti-reversal clip may be used with formed wires that that will also provide for a bendable arm to help hold other materials temporarily or permanently, such conduits, conductors, pipes, tubes, electrical or electronic equipment, etc. It may be made using a turret press from metals such as galvanized steel.

It may be apparent that a novel and useful Insulation Wire Mounting System has been hereinabove described which works and is used in a manner not consistent with conventional products and methods.

It is therefore an object of the present application to provide an Insulation Wire Mounting System that is capable of mounting insulation to the exterior of a building with minimal labor.

Another object of the present application is to provide an Insulation Wire Mounting System that penetrates the weather barrier in as few locations as possible to prevent water and/or moisture or other elements from getting behind it which may deteriorate the quality of the building's substrate.

Another object of the present application is to provide an Insulation Wire Mounting System that doesn't penetrate the weather barrier more than necessary to prevent thermal transfer to the building, providing a more thermally efficient insulation system.

Another object of the present application is to provide an Insulation Wire Mounting System that doesn't penetrate the weather barrier to prevent vibration (noise) from transferring to the building, effectively reducing noise pollution into the building.

Another object of the present application is to provide an Insulation Wire Mounting System that provides specially shaped impaling ends that allow the formed wires to enter the insulation and then be prevented from backing out or moving once installed.

Another object of the present application is to provide an Insulation Wire Mounting System that helps with safety by reducing the amount of insulation dust by eliminating drilling required to install pins through the insulation and into the building.

Another object of the present application is to provide an Insulation Wire Mounting System that provides the ability to install the insulation vertically or horizontally.

Another object of the present application is to provide an Insulation Wire Mounting System that allows the Sub-girts to be installed vertically and horizontally.

Another object of the present application is to provide an Insulation Wire Mounting System that provides various shaped anti-reversal impaling ends and arms to hold the impaled materials or formed wire in a specific orientation or position.

Another object of the present application is to provide an Insulation Wire Mounting System with formed wire that can be used with any assembled or formed thermal clip such as those from Knight Wall, ISO Clip, ACS Clips, Cascadia Clips, Green Girt, etc.

Another object of the present application is to provide an Insulation Wire Mounting System that allows for easy removal of the insulation if needed so that the insulation can be re-used and not destroyed.

Another object of the present application is to provide an Insulation Wire Mounting System with formed wire 'stitches' that work to hold smaller insulation pieces together with larger fixed-in-place insulation pieces.

Another object of the present application is to provide an Insulation Wire Mounting System with formed wires that are arched to accommodate the angled installation of the insulation and/or Façade Materials, which also allows for penetration both in depth and width into the insulation.

Another object of the present application is to provide an Insulation Wire Mounting System that reduces the amount of electrical travel from the outside of the building to the inside by eliminating additional components from penetrating the wall of the building, such as insulation pins.

Another object of the present application is to provide an Insulation Wire Mounting System that can be used with any insulation material such as mineral wool and foam board poly-iso.

Another object of the present application is to provide an Insulation Wire Mounting System that allows for longer batts or rolls to be used which will provide less manufacturing and even faster installation onto walls.

The invention possesses other objects or advantages especially with concerns towards the particular characteristics and features thereof which will become apparent as the specification continues.

Figure 1:
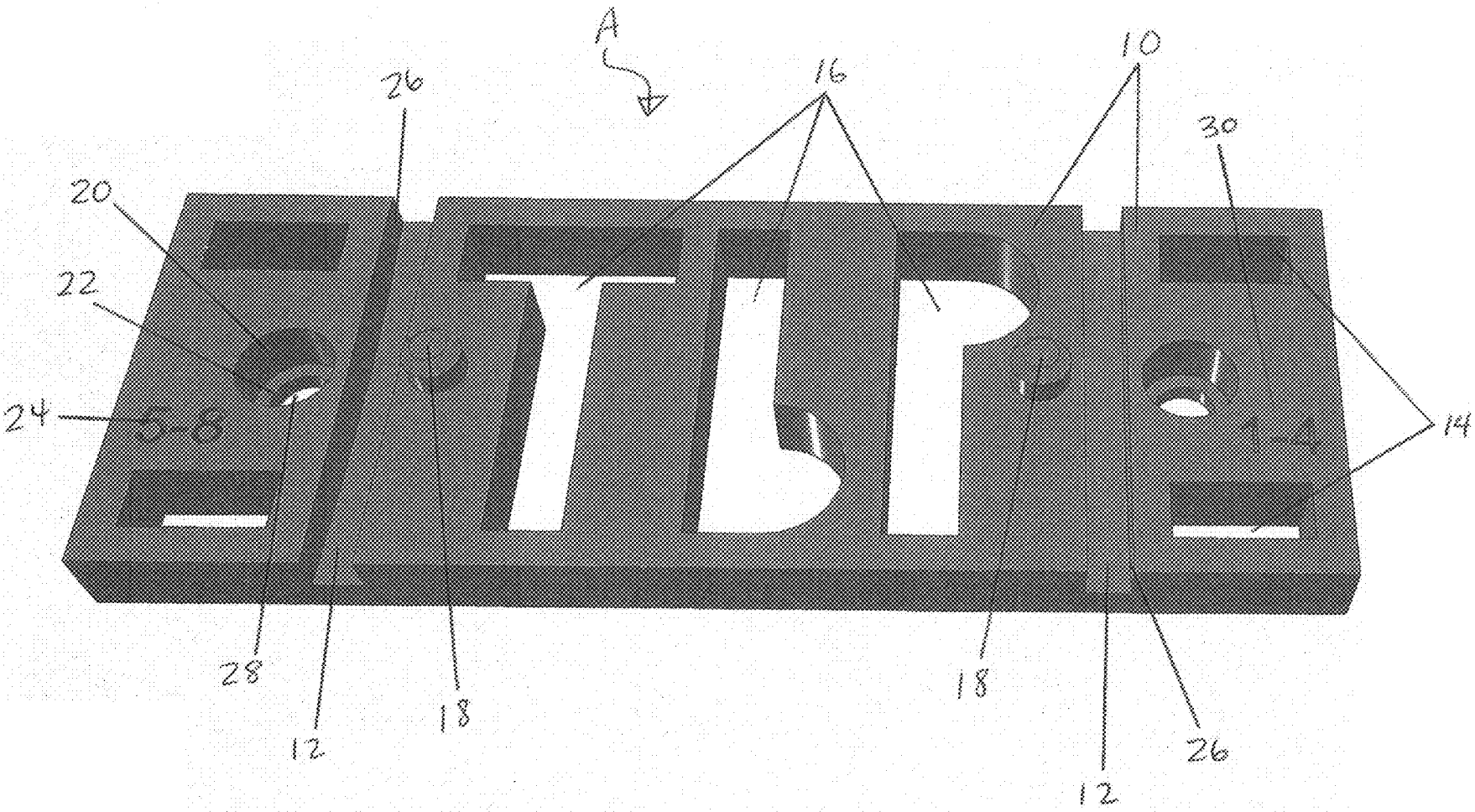
FIG. 1 is a 3D isometric plan view of the thermal break of the preferred embodiment.

For a better understanding of the invention of this application, reference is made to the following detailed description of the preferred embodiments thereof which should be referenced to the prior described drawings.

DETAILED DESCRIPTION OF THE INVENTION

Various aspects of the present application will evolve from the following detailed description of the preferred embodiments thereof which should be taken in conjunction with the prior described drawings.

Embodiments of the invention are identified by reference character A followed by an upper case letter to denote the variations of the same. The assembled embodiment of the preferred embodiment is denoted as ZZ. Elements of the embodiments are identified by numerical reference.

With reference to FIG. 1, it may be observed that thermal break A is depicted which includes base 10 having at least one contiguous surface, and may be separated by at least one slot 12. Slots 12 may have different radiuses in the bottom of the slots, and may be different widths to accommodate differing width formed wires B (shown in FIG. 2). Cavities 14 help reduce material usage without significant loss of structural or thermal transfer properties. Cavities 16 also help reduce material usage without significant loss of structural or thermal transfer properties, but also act as a marketing tool to installers. Nubs 18 are used to frictionally fit into holes 50 of structural clip C of FIG. 3. Cavity 20 is formed for installation of a mechanical fastener (not shown) but may not directly contact the fastener. Ledge 22 firmly contacts the mechanical fastener (not shown) allowing it to pass into through hole 28 during installation, but helps prevent it from backing out after installation similar to a 'nyloc' nut (not shown) used for anti-reversal of machine bolts (not shown). Cavities 24 and 30 are of numbers showing the insulation thicknesses to be used on each side as the radii and widths in slots 12 may differ for insulation batt 86 (FIG. 10) thickness and width. Walls 26 tightly fit formed wire B of FIG. 2 to help prevent it from moving perpendicular to the radius of formed wire 8, especially when structural clip C of FIG. 3 is positioned over the top to prevent formed wire B from coming out of slot 12.

Figure 2:
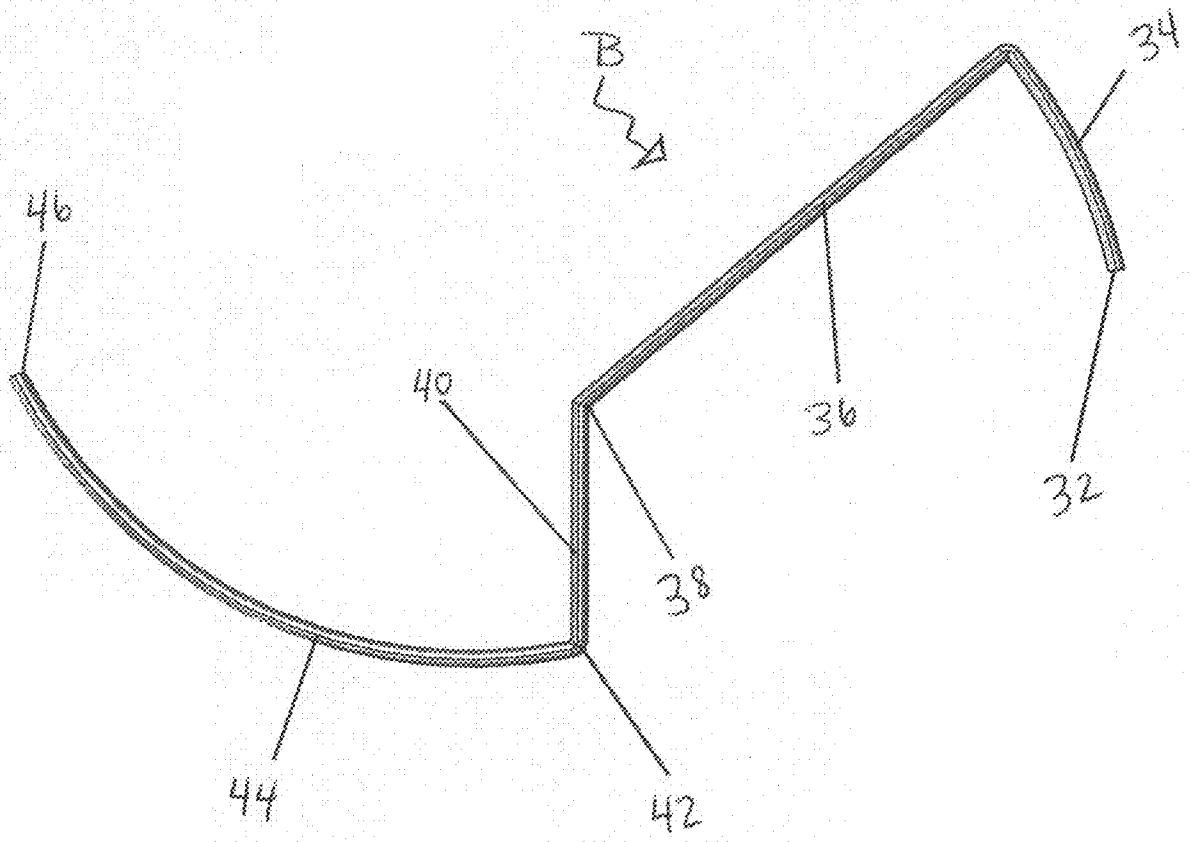
FIG. 2 is a 3D elevation isometric view of a formed wire of the preferred embodiment.

Referring now to FIG. 2 it may be observed that formed wire B is shown having impaling end 32 at the end of radiused arm 34 which is substantially perpendicularly positioned to arm 36. Bend 38 is pre-bent but will be bent further and permanently during installation. Arm 40 is substantially perpendicular to radiused arm 44 at bend 42, with radiused arm 44 having impaling end 46 at it's extremity.

Figure 3:
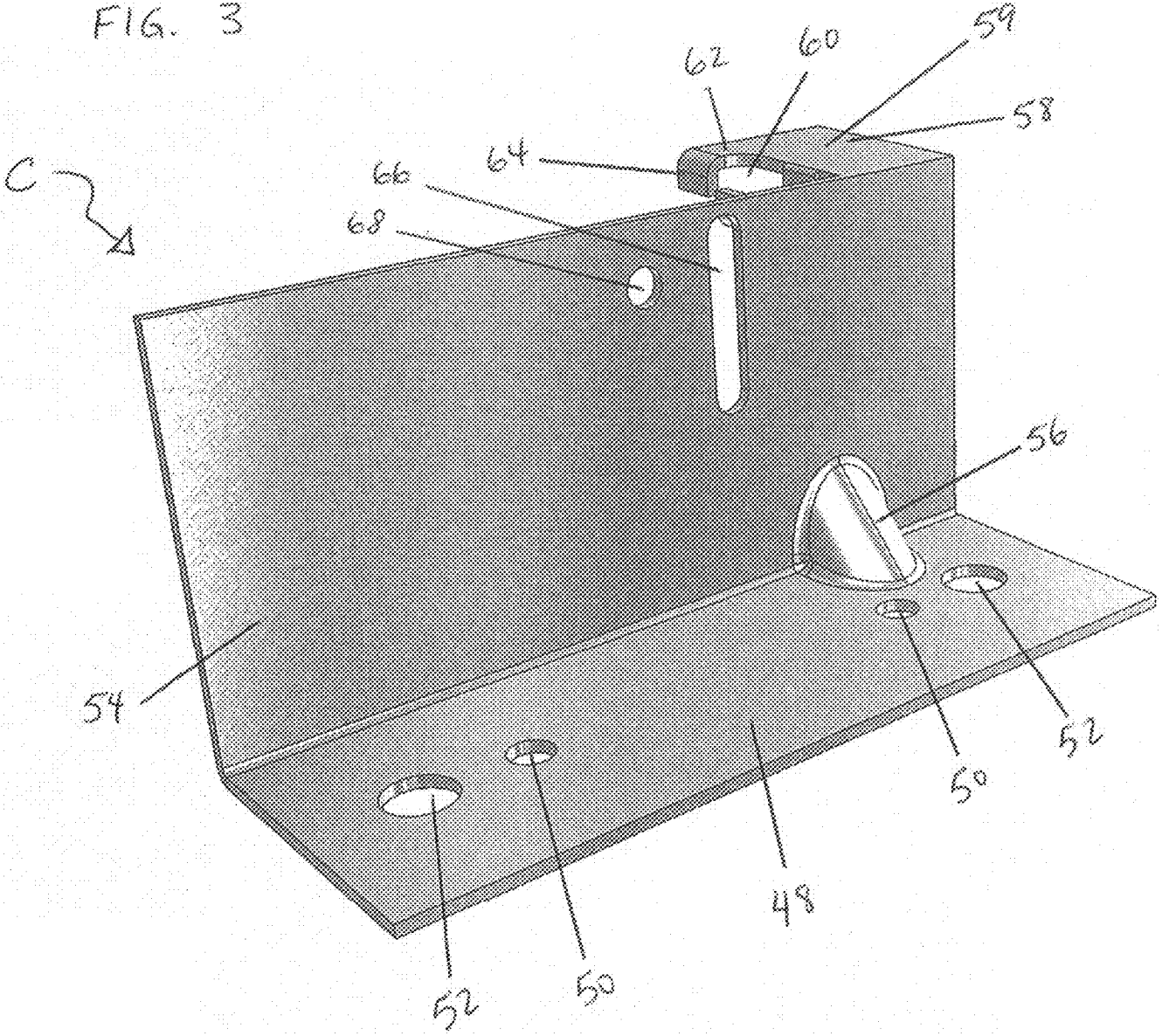
FIG. 3 is a 3D elevation isometric view of a structural clip of the preferred embodiment.

With reference to FIG. 3, structural clip C is shown having base 48 with nub holes 50 for insertion of nubs 18 of thermal break A. Holes 52 align with holes 20 of thermal break A for insertion of mechanical fasteners (not shown) as an assembly. Side 54 is used to fasten mechanical fasteners (not shown) wherever needed when installing sub-girts (not shown) permanently. Gusset 56 helps strengthen structural clip C's permanent shape. Arm 58 is may be a screwed into anywhere on horizontal plane 59. Finger 62 protrudes from arm 59 with hook 64 positioned downwardly for a short distance. Space 60 is created therebetween which will allow for formed wire B to occupy during installation. Slot 66 allows for a mechanical fastener (not shown) to pass through to engage a sub-girt (not shown) which will allow the sub-girt to be placed in the correct position before fastening another mechanical fastener (not shown) through hole 68 for permanent fixing.

Figure 4:
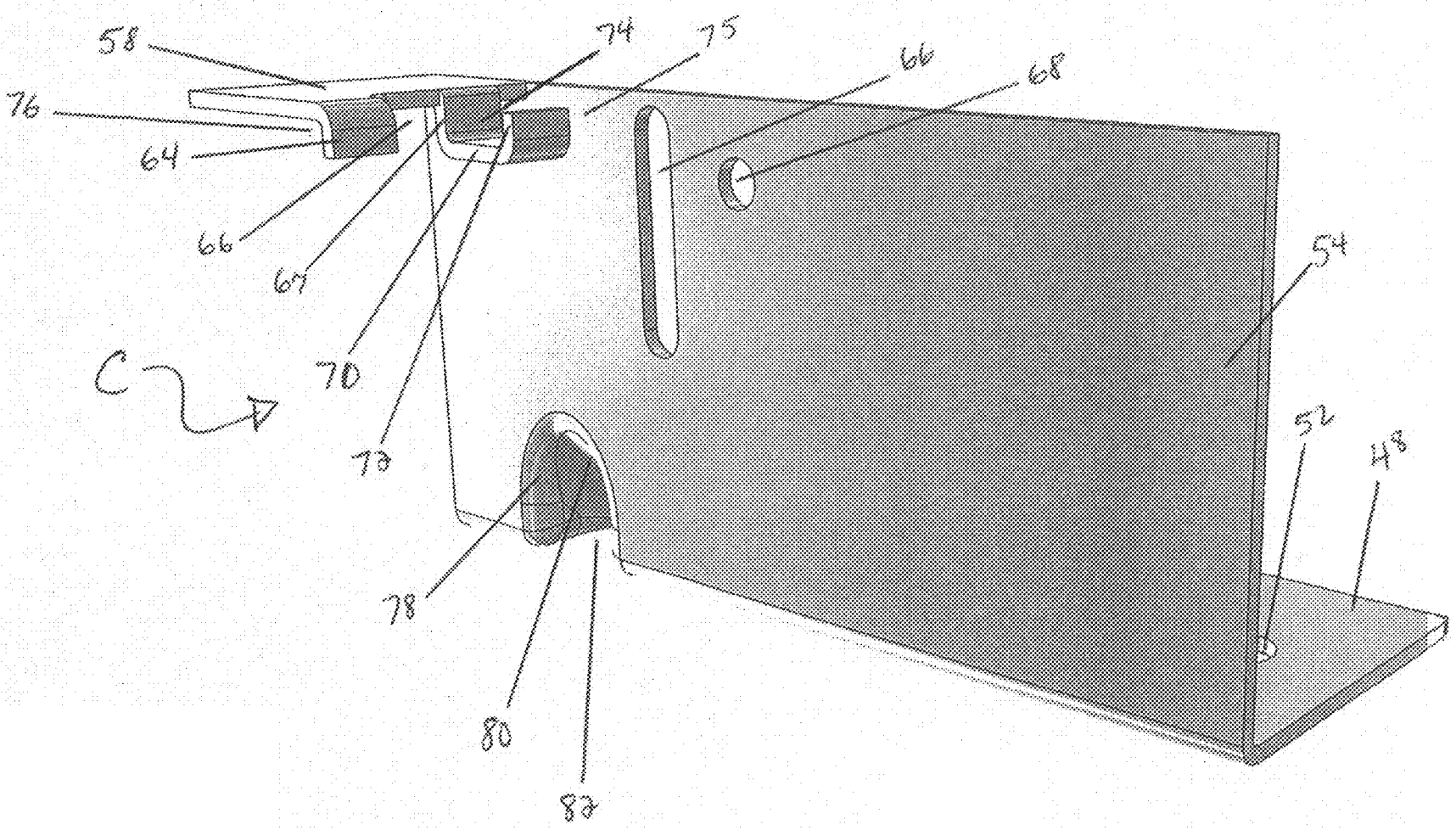
FIG. 4 is a 3D elevation isometric view of back the Structural Clip of the preferred embodiment.

FIG. 4 shows the reverse side of the structural clip C of FIG. 3 further containing drop down 67 supporting ledge 70 and upright 72 which provides for slot 74. Ledge 70 is spaced apart from side 54 creating space 75 for positioning of formed wire B behind during installation but before final bending of bend 38. Formed wire B is further bent at bend 38 on the inside edge of ledge 70 so that formed wire B rests in slot 74. Arm 36 is then pushed under hook 64 where it will spring back into surface 76 where it will remain locked in position. Insulation batt (not shown) will be tight against the bottom of hook 64 and the bottom of arm 36 of formed wire B to prevent formed wire B from departing from structural clip C. Radiused entrance 78 along with gusset interior 80 provide space 82 that allows for fast and easy insertion of formed wire B into slot 12 when thermal break A is attached to structural clip C.

Figure 5:
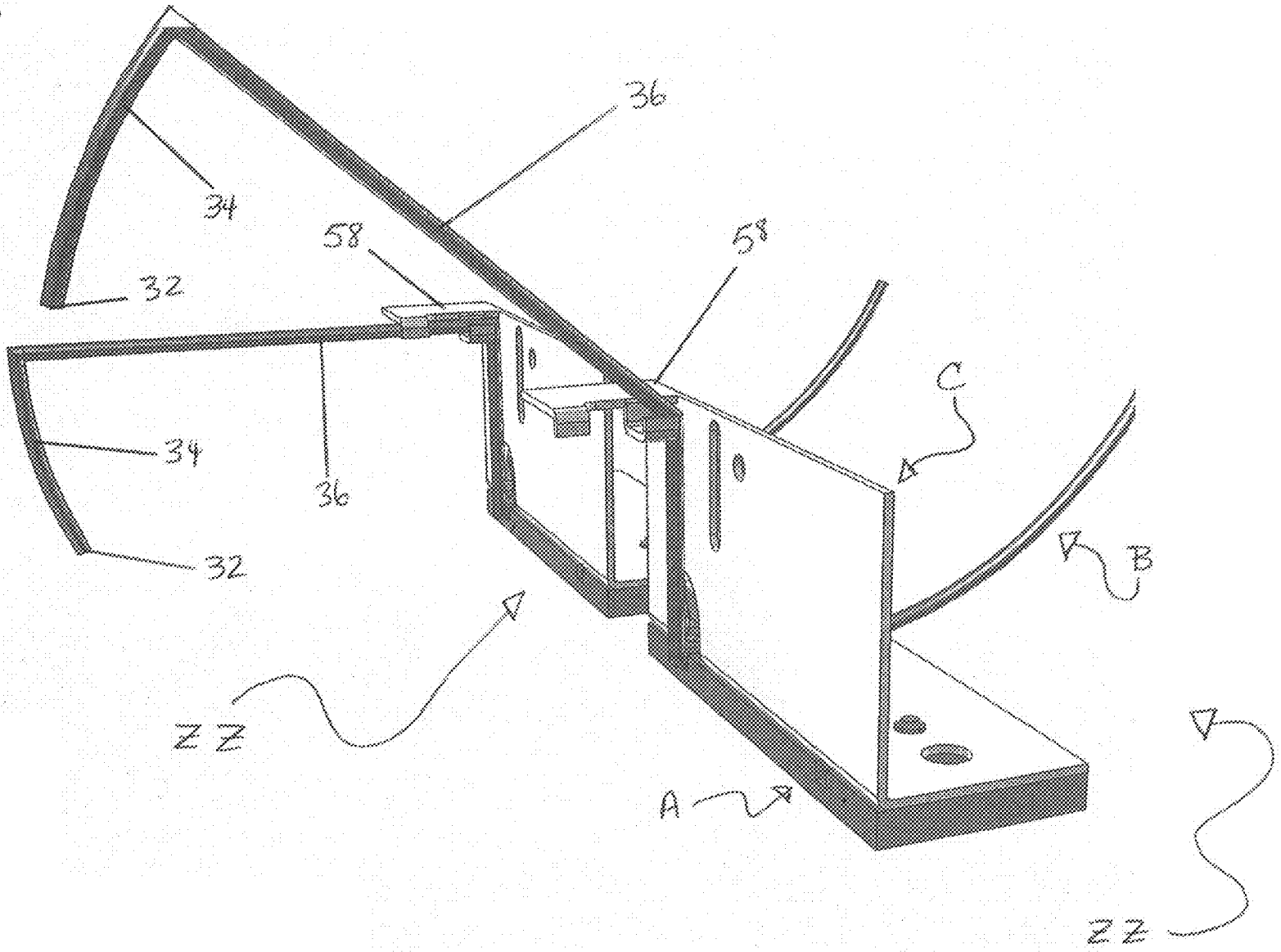
FIG. 5 is a 3D front/side isometric view of two of the assembled thermal dips with formed wires installed. The closer assembled thermal clip shows the wire still in the upward position prior to insulation being installed on that side. The farther assembled thermal clip shows the formed wire bent downwards as if the insulation had already been installed.

FIG. 5 shows 2 sets of assembled thermal clip ZZ. The near assembled thermal clip ZZ possesses formed wire B's arm 36 not yet bent but positioned in space 75 and ready to be bent. The for assembled thermal clip ZZ shows formed wire B fully bent at bend 38 and permanently positioned in slot 74 and under surface 76.

Figure 6:
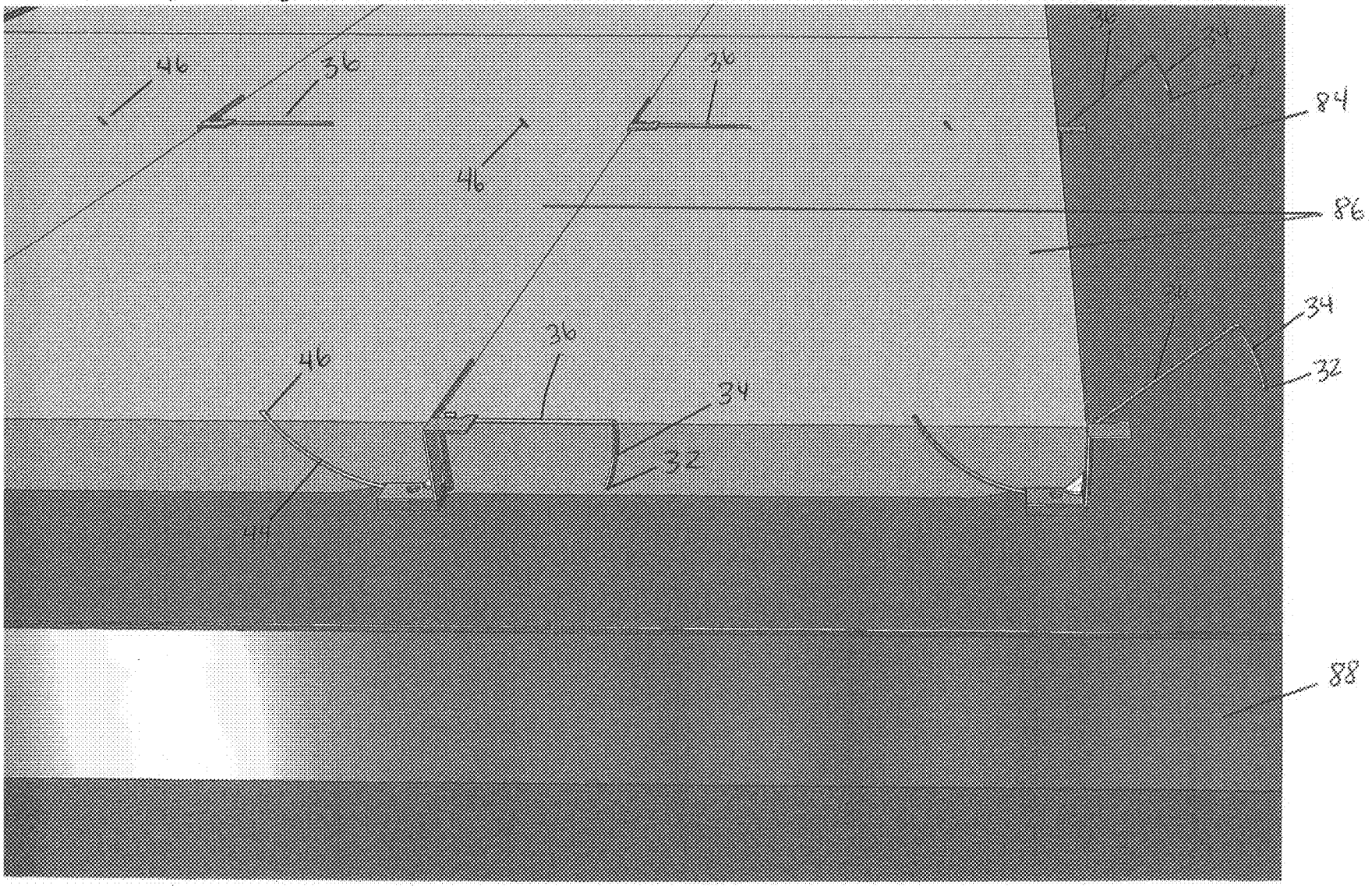
FIG. 6 shows a section view of the assembled thermal clips installed on a wall with the insulation being installed. The insulation is pulled back at the assembled thermal clip to show how each part shown of the present invention interact with the insulation.

FIG. 6 shows a sectional view of a wall assembly with assembled thermal clip ZZ with formed wire B fully inserted to insulation 86 in all locations except for those on the right side where insulation 86 has not yet been inserted. Weather barrier 84 is shown in the background and sill 88 is positioned at the bottom of the wall assembly.

Figure 7:
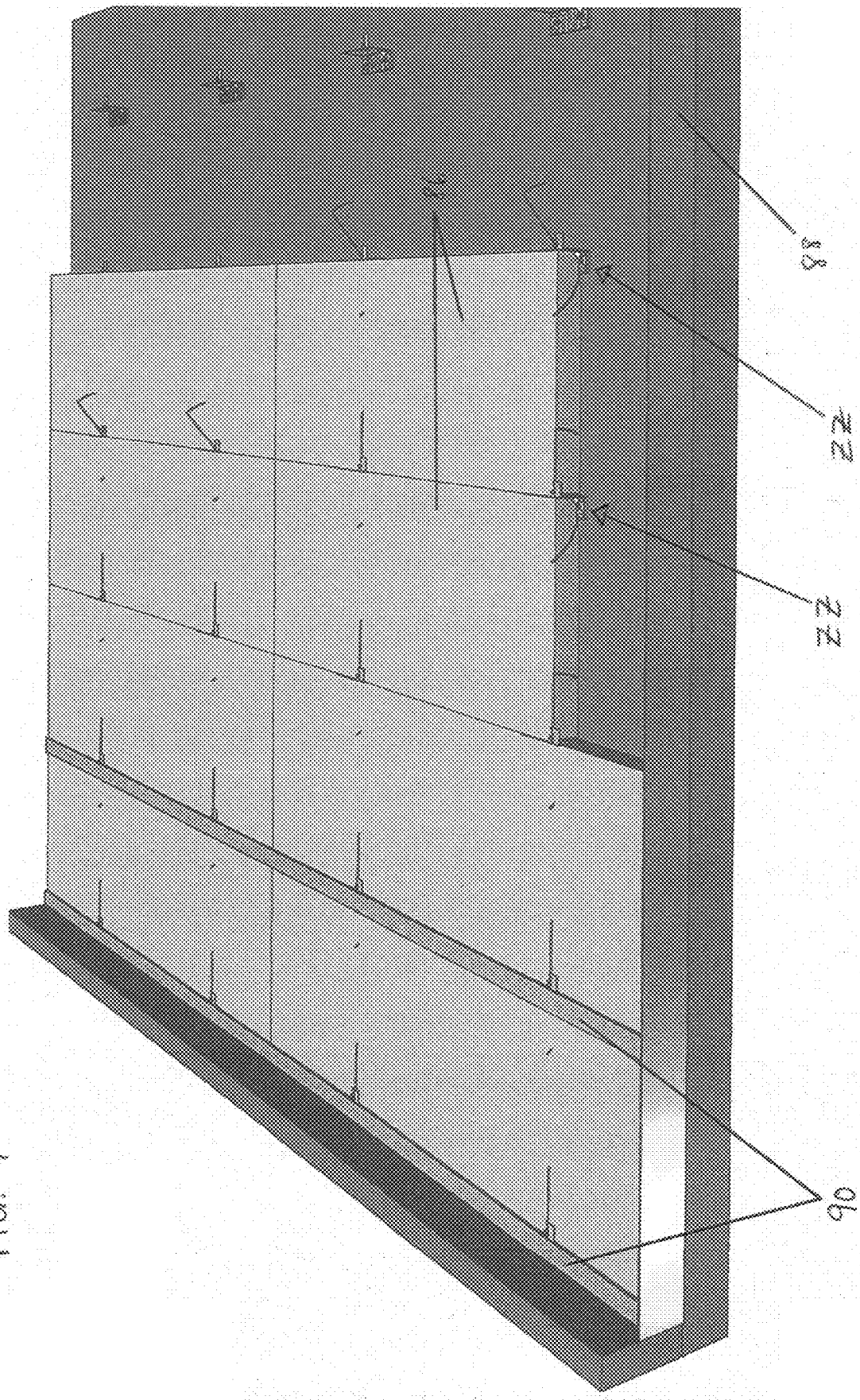
FIG. 7 shows a fuller view of the section view of FIG. 6 with insulation batts installed onto the wall which includes a sill on the bottom and jamb on the left. The insulation batts on the left are fully installed and the batts on the far right are in the process of being installed. The formed wires in this drawing are pre-bent, but final bending by hand of the band at the structural clip has not been done on some of the formed wires to the right.

FIG. 7 shows a more complete wall assembly of FIG. 6 with sub-girts 90 installed vertically.

Figure 8:
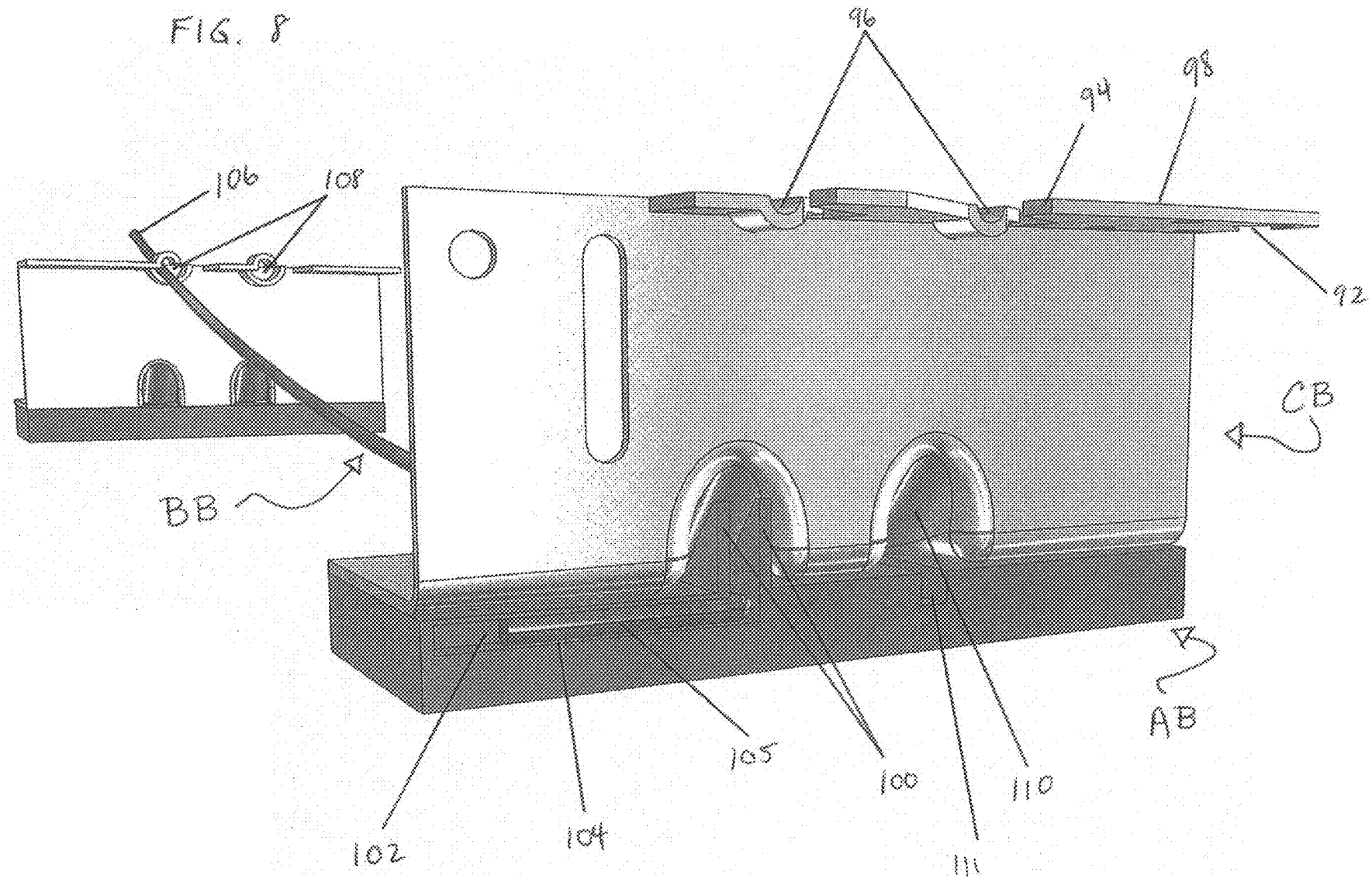
FIG. 8 shows a rear isometric view of an alternate thermal break, structural clip and formed wire where the formed wire spans between two assembled thermal dips to hold insulation batts in place when inserted. The impaling end would be bent to prevent it from backing out of the thermal break, as would the anti-reversing portion of the thermal break when the horizontal arm is installed, in addition to the installed insulation batt on the side of the horizontal arm of the formed wire.

FIG. 8 shows an alternate thermal break AB with alternate structural clip CB and alternate formed wire BB. Holes and slots 92 are used to install alternate formed wires (not shown here). Ledge 94 is used to pinch formed wire BB between grooves 96 when receiving impaling end 106 of formed wire BB. Surface 98 may be used to mount 2 girts (not shown) vertically or horizontally via mechanical fasteners (not shown). Thermal break AB has support arms 100 that help prevent lateral movement of a formed wire (not shown) when the formed wire (not shown) is installed vertically. Slot 102 contains snap 104 to prevent arm 105 of formed wire BB from pulling back out once it's positioned into slot 102 and past snap 104. Opposing grooves 108 may be used in place of ledge 94 for a more positive hold on formed wire 8B. Space 110 creates a larger opening for impaling end 106 to enter which will guide impaling end 106 into the radiused slot 111 quickly and easily.

Figure 9:
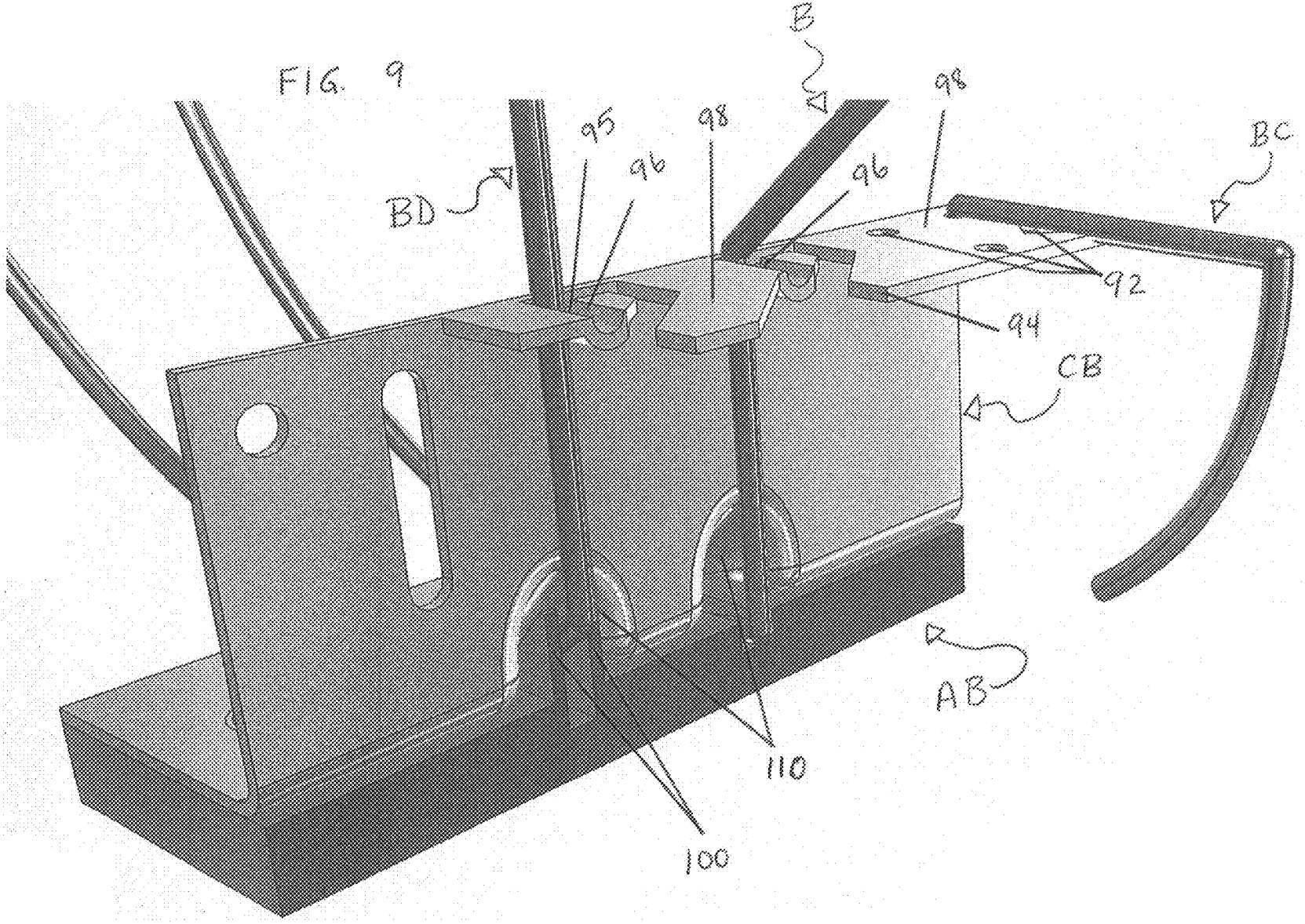
FIG. 9 shows a 3D isometric view of the back of an alternate thermal clip with support arms that assist in keeping the formed wire from moving side to side in conjunction with the inside of the gusset. There are also various shaped formed wires that once installed and bent into position can't be easily positioned otherwise.

FIG. 9 shows the thermal break AB and structural clip CB of FIG. 8 with assorted formed wires inserted including B, BC and BD.

Figure 10:
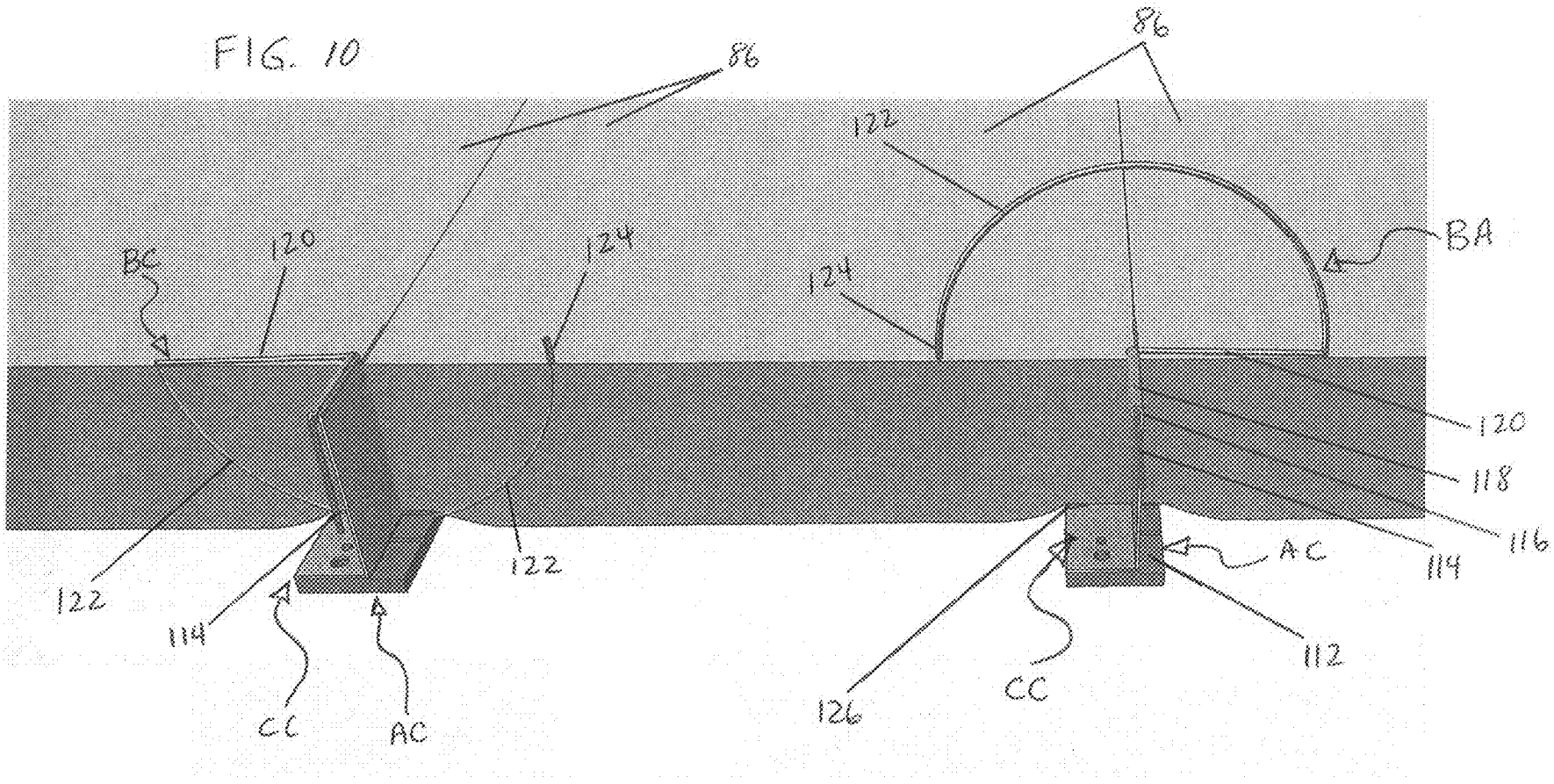
FIG. 10 shows a 3D isometric sectional view of an alternate thermal break, structural clip and formed wire where the formed wire is installed into the structural clip on the right, and on the left the same formed wire has been fully rotated into the insulation with the horizontal arm protruding out of the bottom of the structural clip bent downwards in order to prevent the formed wire to back out when insulation is installed on both sides of the assembled thermal clip.

FIG. 10 shows an alternate embodiment with formed wire BA fully inserted into insulation 86 on the left side of the drawing, and formed wire BA not yet inserted into insulation 86 on the right side of the drawing. This alternate embodiment shows thermal break AC, structural clip CC and formed wire BA. Thermal break AC has surface 112 that protrudes past the end of the structural clip CC which has not been common for the previous thermal breaks. Surface 112 holds insulation 86 up so that formed wire BA can penetrate each insulation batt 86 from the very bottom in order to penetrate all layers in the thickness of insulation 86. Insertion arm 114 of formed wire BA slides through inside of barrel 118 of structural clip CC and comes out end 116 when fully inserted. Arm 120 is positioned perpendicular to insertion arm 114, and is also positioned substantially perpendicular to the beginning of radiused arm 122 having impaling end 124. Teardrop shaped hole 126 is made in structural clip CC to help guide formed wire BA's impaling end 124 into slot (not shown) of thermal break AC. Radiused arm 122 is perpendicular in plane to insertion arm 114, and insertion arm 114 is in the center of the radius of radiused arm 122 in order to provide the smoothest passage through insulation 86.

Figure 11:
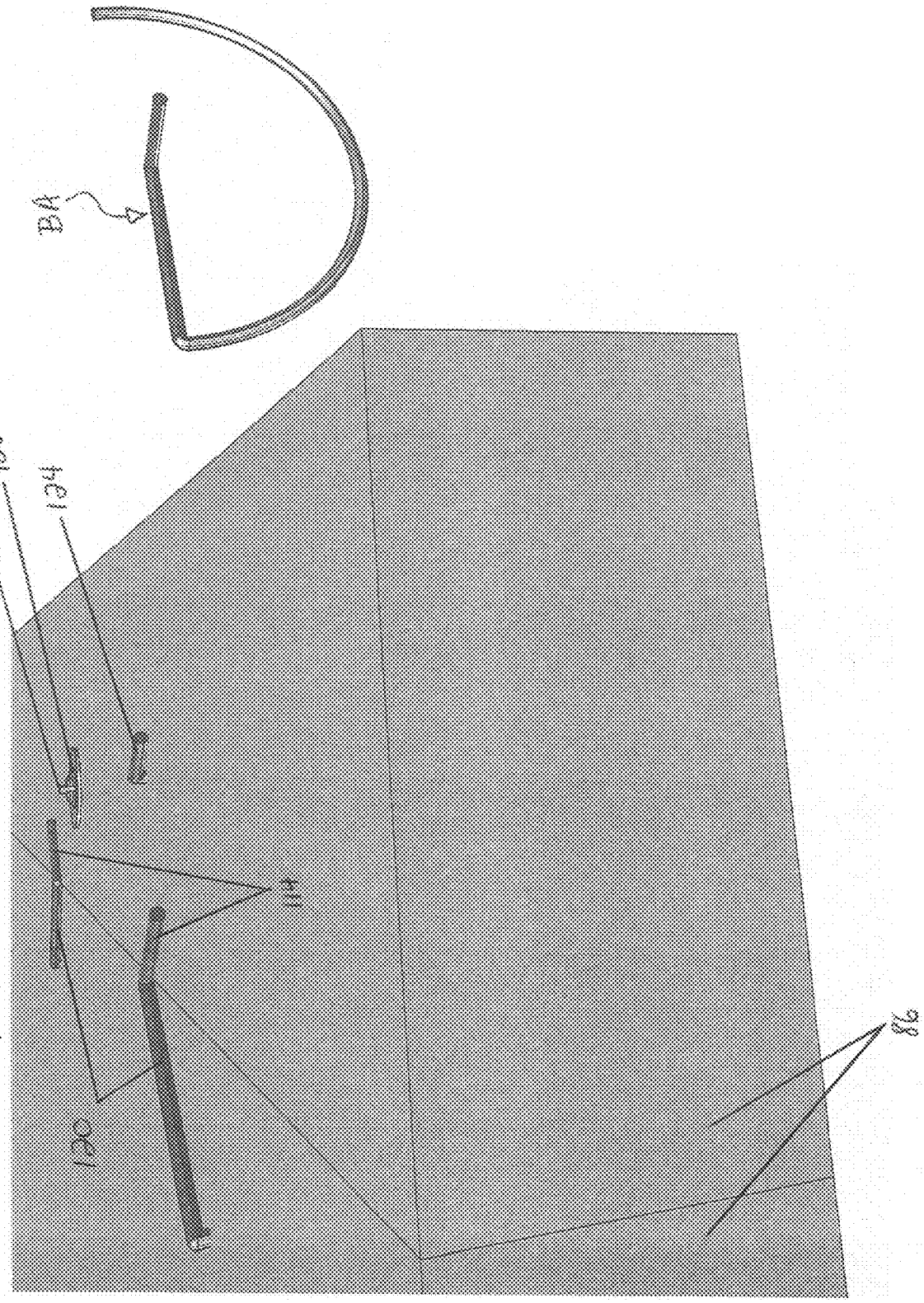
FIG. 11 shows a 3D isometric side view of the formed wires of FIG. 10 being used as a 'stitching' mechanism to combine smaller pieces of insulation to larger pieces of insulation without the used of other structural means. The formed wire is turned into both pieces of insulation to hold them together in a fashion similar to stitching a wound on a person. Once fully inserted, the impaling end can be bent over similar to the closer inserted formed wire, or have an anti-reversal clip attached similar to the more distant formed wire.

FIG. 11 shows formed wire BA of FIG. 10 used as a 'stitching' device to combine 2 separate pieces of insulation 86 together side by side. There are 2 formed wire BA's shown inserted into insulation 86 with the one closer fully inserted into the 2 pieces of insulation 86 and then having impaling end 124 bent to prevent it from backing out. The farther away formed wire BA has an anti-reversal clip 128 attached to the impaling end 124 so that it can't back out.

Figure 12:
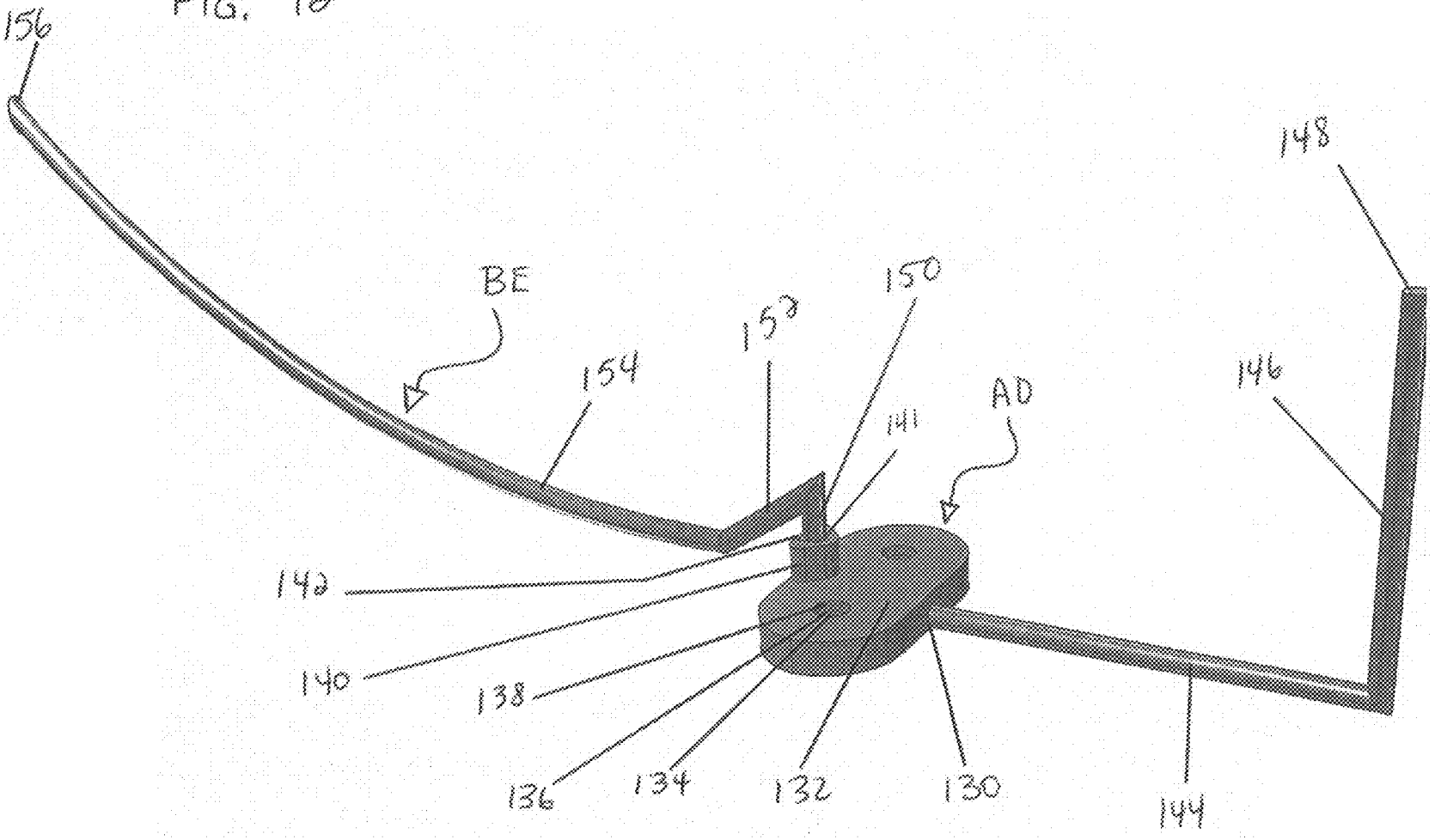
FIG. 12 shows in 3D isometric view an alternate formed wire with an alternate thermal break that may be used between assembled thermal clips when the spacing is too far away to effectively capture the insulation properly. The assembly of this drawing would have the radiused portion of the formed wire to be installed into the insulation on the left first, then the thermal break would be mechanically fastened to the building substrate to hold the assembly in place prior to the insulation on the right being installed over the vertical pin. The vertical pin would require an anti-reversal clip after the insulation is installed.

FIG. 12 shows an alternate thermal break AD with alternate formed wire BE which would be used between assembled thermal dips ZZ when they are spaced too far apart to assist holding insulation 86 in place properly. Thermal dip AD has slot 130 under surface 132 for insertion of formed wire BE which will be captured temporarily in vertical slot 141 and snap 142. Through hole 134 has an outer diameter bore 136 with inner ledge 138 to be used as a 'nyloc' style anti-reversal mechanism for mechanical fasteners (not shown). Arm 144 of formed wire BE is perpendicular to arm 146 with impaling end 148 on one side, and perpendicular to arm 150 which snap fits into vertical slot 141. Drop arm 152 brings radiused arm 154 closer to the weather barrier (not shown) but doesn't touch it. Impaling end 156 is inserted into insulation 86 manually before thermal break AD is fastened to the substrate.

Figure 13:
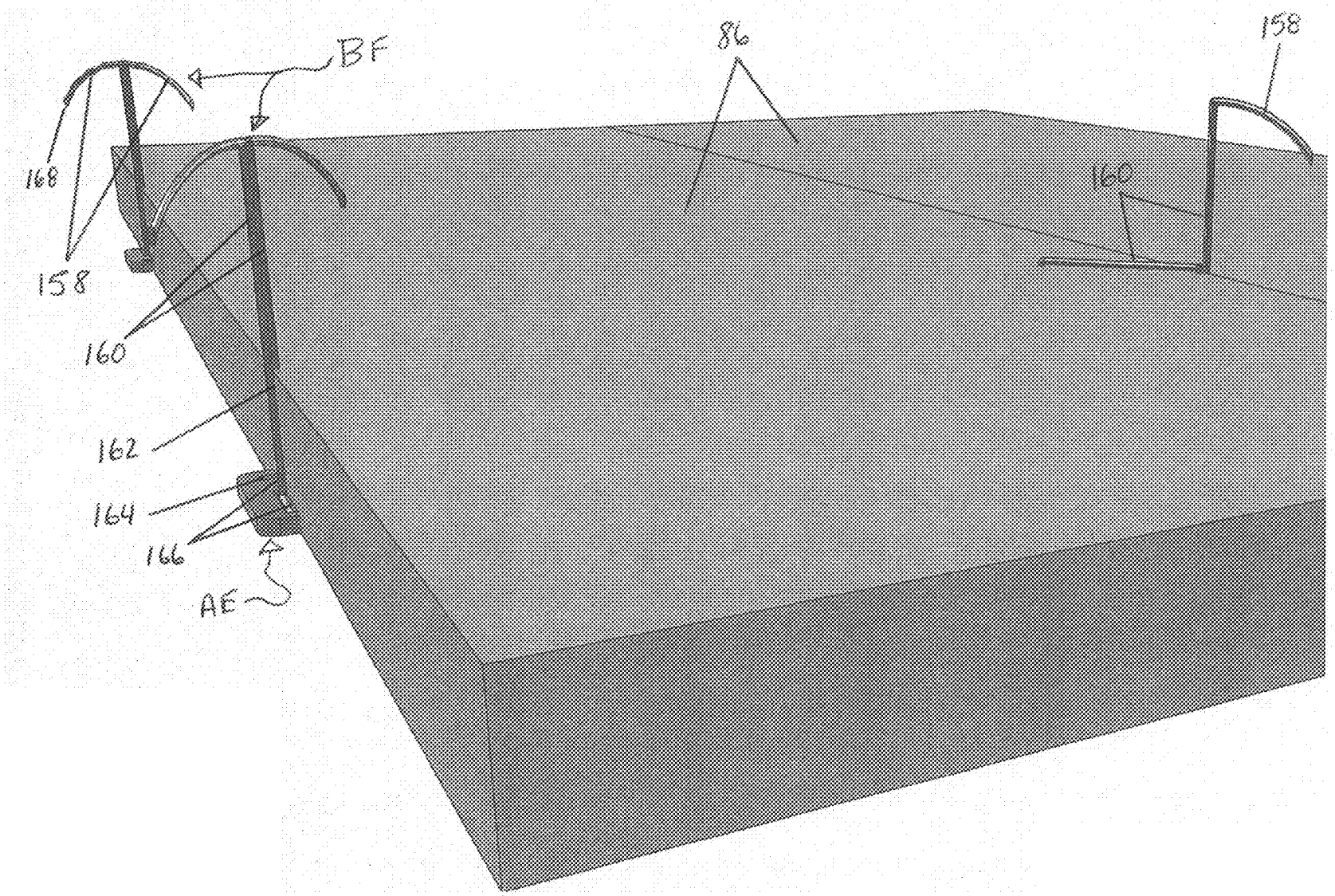
FIG. 13 shows in 3D an isometric view of an alternate formed wire and thermal break combination where the formed wire is welded at the level below the installed insulation so that the left and right arms of the formed wire can be separated and inserted into the installed insulation to hold them in place permanently. The screw that holds the thermal break to the building substrate also contacts and prevents the formed wire assembly from leaving the thermal break once installed.

FIG. 13 shows an optional thermal clip AE and optional formed wire BF. Formed wire BF has radiused arms 158 positioned substantially perpendicular to arms 160 which are affixed to each other via weld or other mechanical fastening means no higher than the surface location of the insulation 86, shown at location 162. Mounting holes 164 of thermal break AE are adjacent to feet 166 of formed wire BF so that when mechanical fasteners (not shown) are installed their flange also covers the top of feet 166 to prevent formed wire BF from coming away from thermal break AE. Impaling ends 168 penetrate insulation 86, one in each adjacent insulation batt 86 when arms 160 are bent away from each other in opposing directions, putting radiused arms 158 fully into two separate insulation batts 86. The outer edge of radiused arms 158 are positioned at angles to the edge of insulation batts 86 so as to minimally interfere with the a installation of insulation ban 86. Radiused arms 158 may be moved to the side by insulation 86 or the person installing (not shown) in order to fit insulation batt 86 into it's final fixed position.

Figure 14:
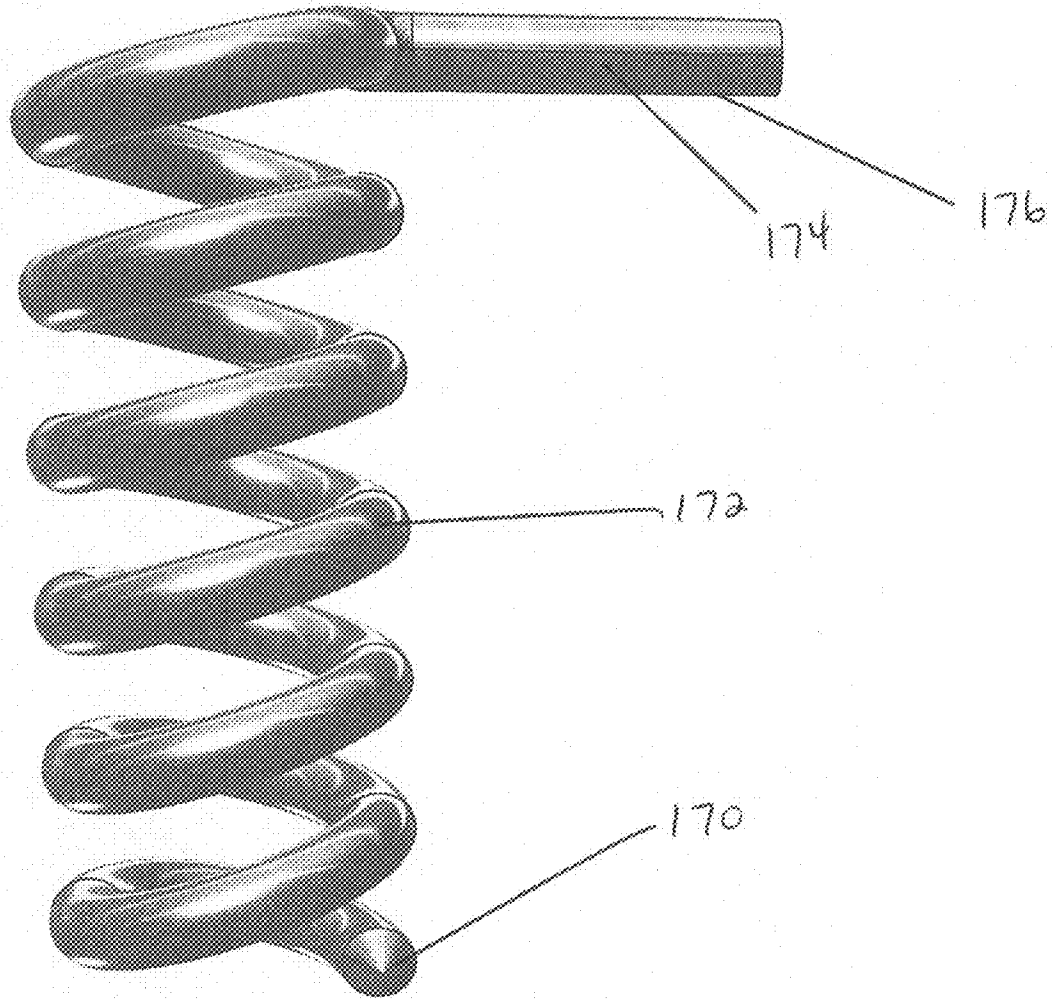
FIG. 14 shows in 3D an elevation isometric view of a cork-screw style formed wire that would engage the thermal break and/or structural clip or sub-girt in order to penetrate the rigid insulation to hold it in place once fully inserted. The horizontal arm of the formed wire would be held in place and prevented from backing out utilizing anti-reversal hooks barbs in or on the thermal break and/or structural dip/sub-girt.

FIG. 14 shows an alternate formed wire BG that may be used like a cork screw to insert into and hold insulation 86 in place, being directed and ultimately held by a thermal break (not shown), structural clip (not shown) and/or sub-girt (not shown). Formed wire BG has impaling end 170, spiral 172, turning arm 174 and bendable end 176 to prevent it from backing out without the help of insulation 86 preventing it from counter-rotating.

Figure 15:
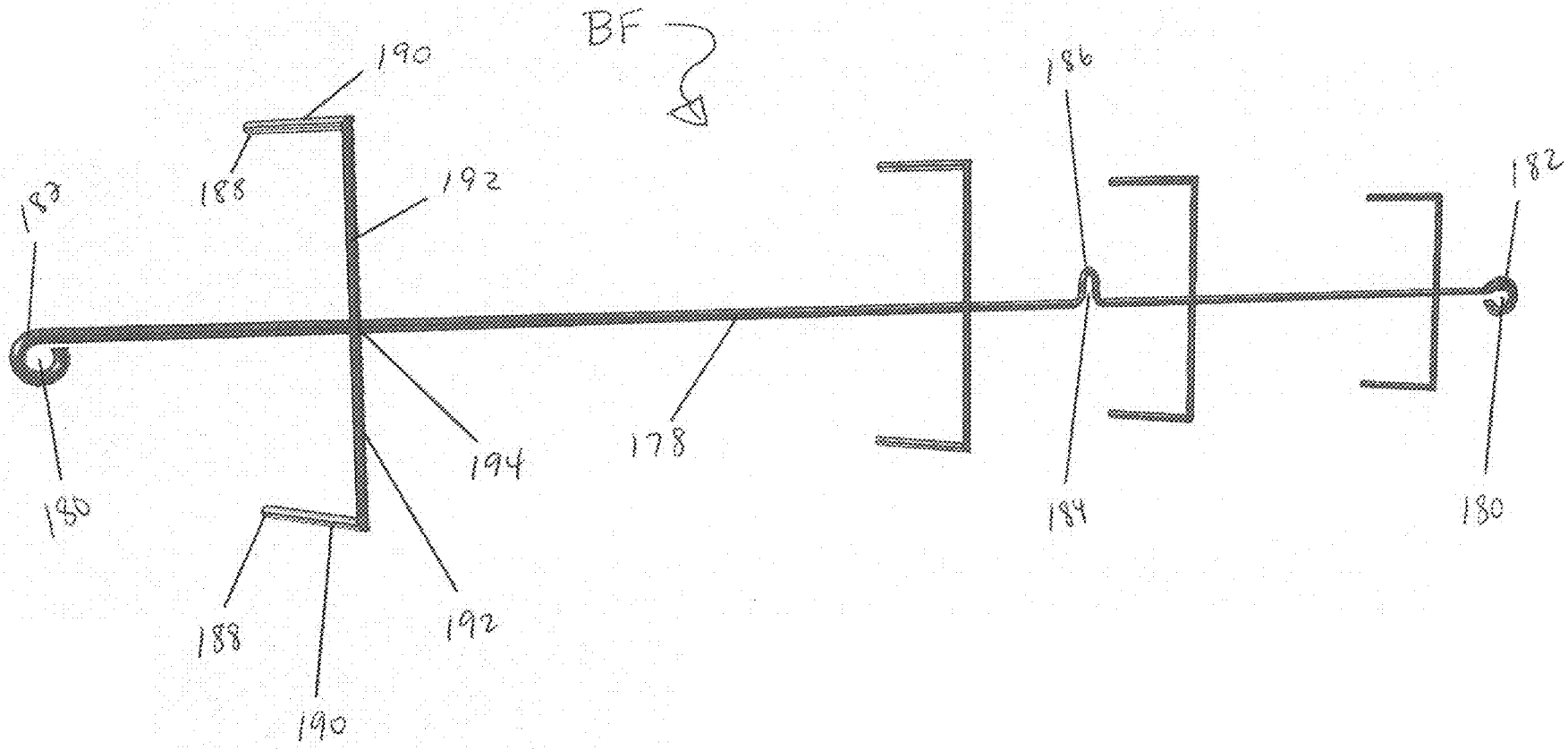
FIG. 15 shows in 3D an isometric plan view of an alternate formed wire assembly that would attach to more than one thermal break or structural clip in a vertical or horizontal orientation as required. The impaling pins would penetrate the insulation from below, above or from the sides from one or more sides (from one side is shown). There would be attachment points at certain locations as required, however fastening means other than this may be used such as specially formed washers with indentations for the wire to fit under when used with screws.

FIG. 15 shows an alternate formed wire BF with mounting main wire 178, attachment holes 180 which are created by loop 182. Arch 184 is for connection to a center structural clip (not shown) or sub-girt (not shown). Arch 184 and holes 180 will be separated by distances that make sense to connect to other structural members, and they can be positioned in any direction in relationship to arms 190 depending on the installation method. Top 186 allows arch 184 to rest on a mechanical fastener (not shown) before and after it's tightened into the substrate. Impaling ends 188 are connected to arms 190 which will be inserted into insulation 86. Arms 190 are positioned perpendicular to arms 192 which are attached by weld at intersection 194.

Figure 16:
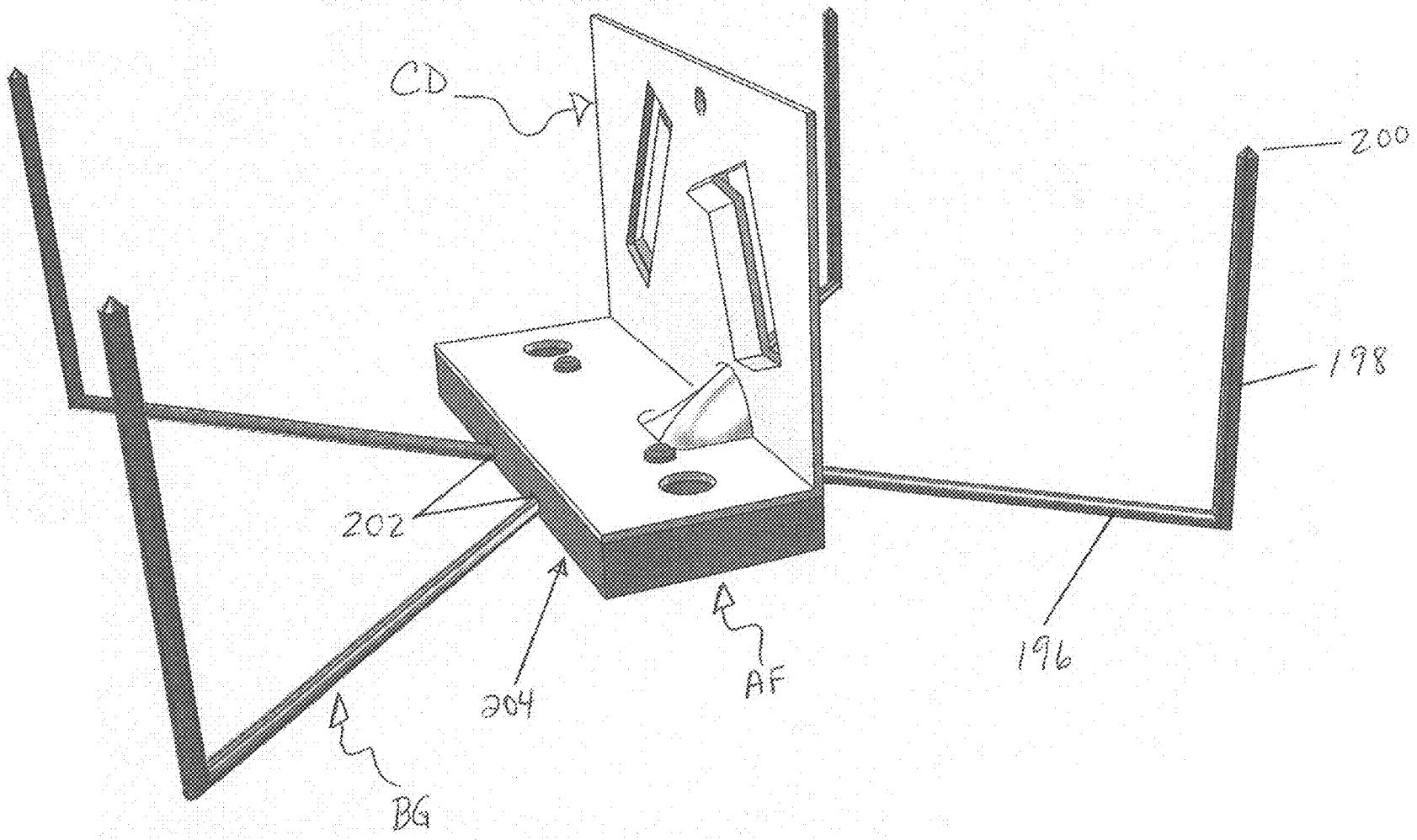
FIG. 16 shows in 3D an isometric side plan view of alternate formed pins or a formed pin assembly, thermal break and structural clip. The formed wires are held in place via grooves, slots or holes in the thermal break. The structural clip has 'helping hands' positioned at angles to help maintain the structural strength of the structural clip yet help prevent some thermal transfer towards the building substrate.

FIG. 16 shows an alternate thermal break AF, alternate structural clip CD and alternate formed wire assembly BG. Formed wire BG has arms 196 that form an "X" when 2 mirrored pieces are welded together in the middle (not shown). The "X" (not shown) is positioned under thermal break AF in slots 202 matching the form of formed wire assembly BG, with slots 202 positioned on the bottom 204 of thermal break AF. Arms 196 are positioned perpendicular to arms 198 having impaling ends 200.

Figure 17:
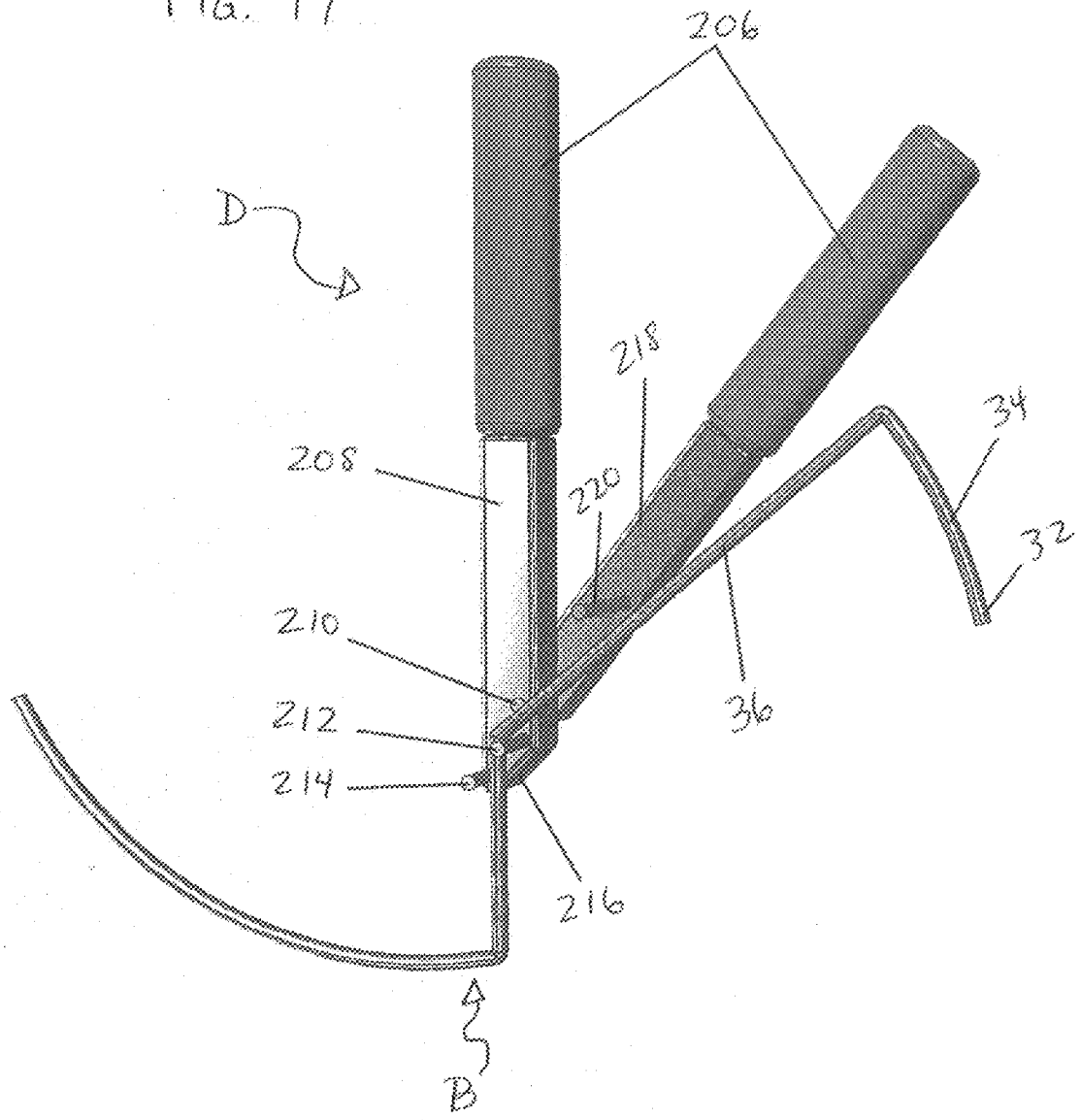
FIG. 17 shows in 3D isometric an elevation view the folding tool of the present invention with a formed wire inserted and ready for final bending of one location of the formed wire.

FIG. 17 shows wire bending tool D having handles 206 covering part of arms 208 and 218. Arms 208 and 218 are connected by pin 210. Pins 212, 214 and 220 are used to work together to bend a wire when formed wire B is positioned in the wire bending tool D and handles 206 are separated from each other. Beveled end 216 allows for wire bending tool D to be inserted between insulation batts 86 to disturb them minimally without damage.

Figure 18:
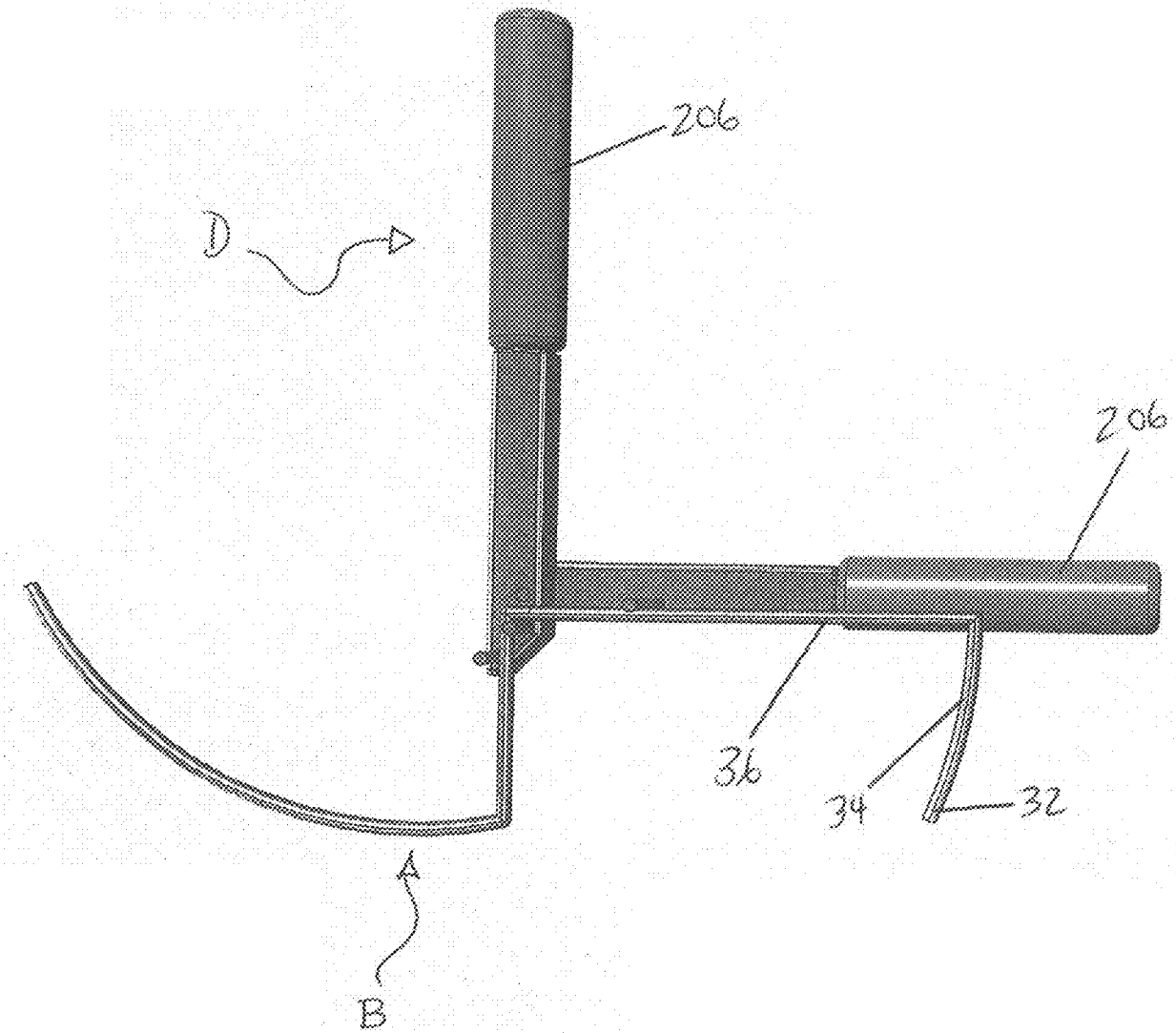
FIG. 18 shows in 3D isometric an elevation view the folding tool of FIG. 17 with the formed wire bent due to the fingers of the folding tool holding the formed wire in one location while bending another with a separate pin. The folding tool would be used in an application as is shown in FIG. 19.

FIG. 18 shows the wire bending tool D of FIG. 17 with formed wire 8 bent to it's final shape.

Figure 19:
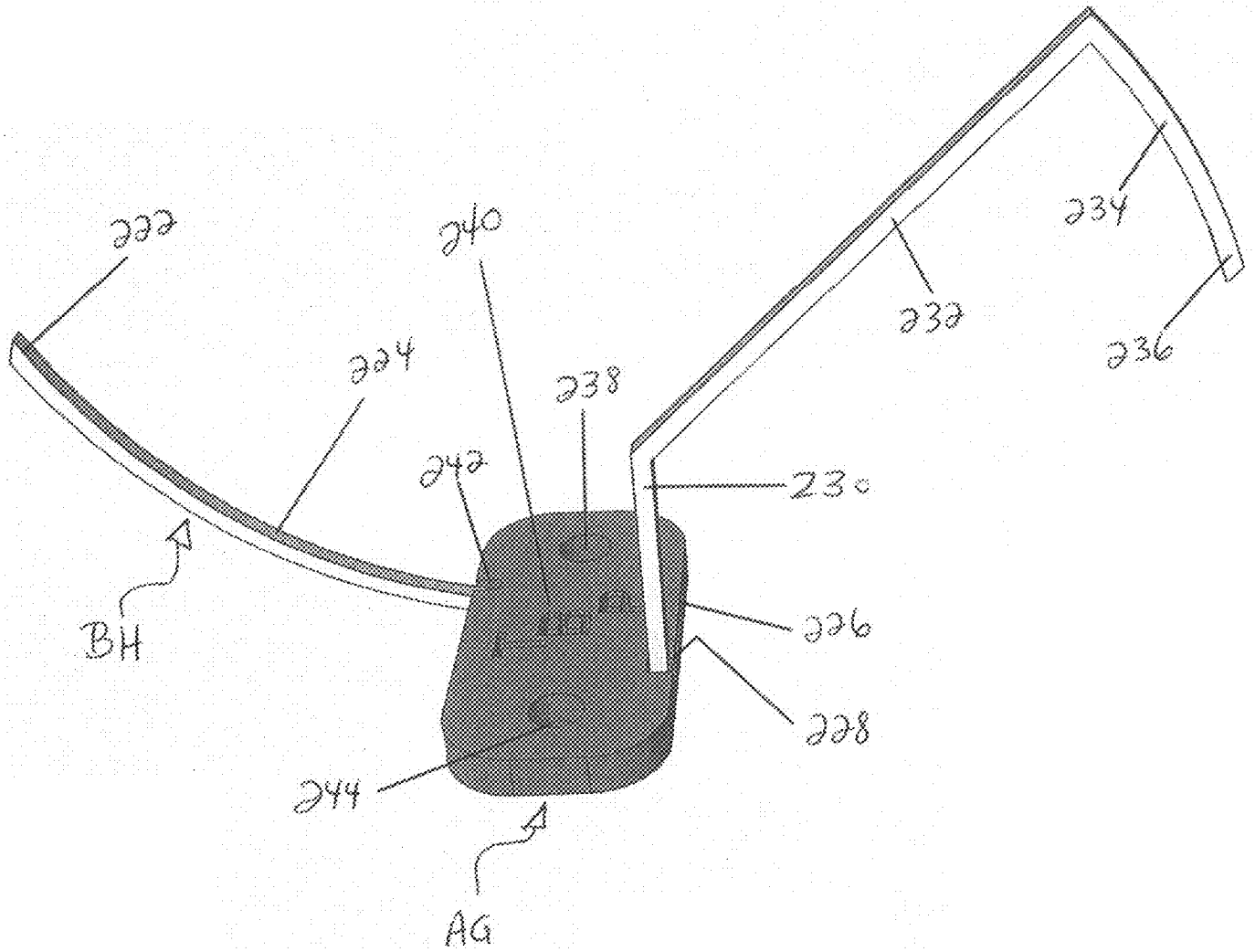
FIG. 19 shows in 3D isometric elevation view of a formed wire and thermal break of the preferred embodiment. The formed wire is a 3 dimensional part whereas many of the others have been 2 dimensional. The thermal break is able to be used from either side as its symmetrical either direction for ease of installation. With this assembly the thermal break is installed when the assembled thermal clips are spaced too far apart, yet the formed wires install similarly as the preferred embodiment. The final bend at the pre-bent location above arm 230 would be made using the wire bending tool of FIGS. 17 and 18.

FIG. 19 shows the preferred embodiment of the intermediate thermal break AG and formed wire BH which will be used when assembled thermal clips 22 are spaced too far apart to correctly hold and support insulation 86. Formed wire BH has impaling end 222 at the end of radiused arm 224. Thermal break has slot 242 for insertion of radiused arm 224 to pass through with the same radius. Snaps 228 of thermal break AG ensure that horizontal arm 226 of formed wire BH doesn't come back out once it's inserted, even without the assistance of adjacently installed insulation 86. Arm 232 is positioned substantially perpendicular to radiused arm 234 which has impaling end 236 at it's extremity. Mounting holes 238 and 244 may be replaced by a single hole (not shown) in the middle of thermal break AG that would assist in holding formed wire BH in position if surface 240 doesn't cover the top of slots 242. The bottom of thermal break AG (not shown) may be concave to help prevent unwanted rotation of it when using only one mechanical fastener (not shown).

Figure 20:
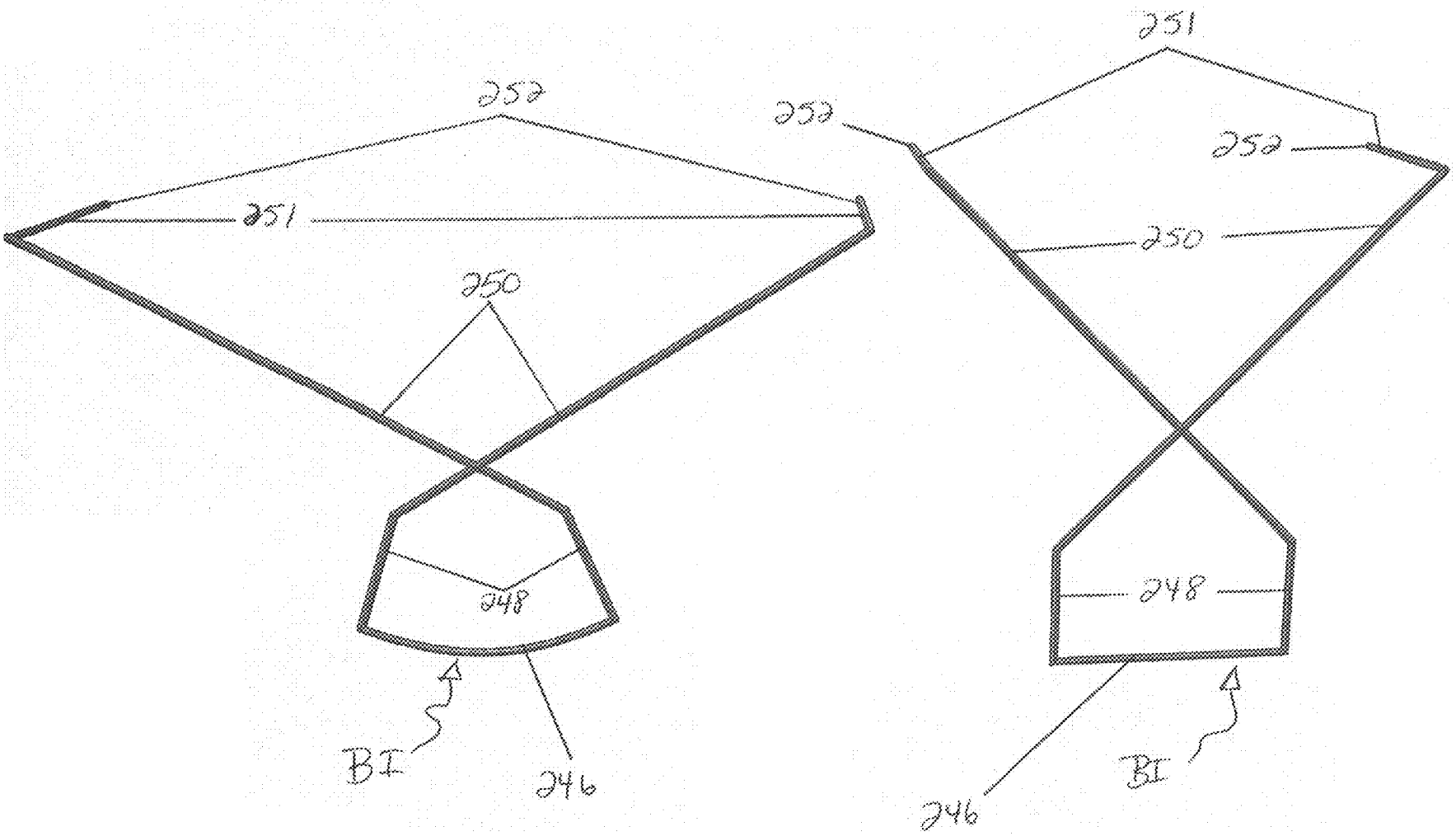
FIG. 20 shows in 3D an isometric plan of a formed wire for 'stitching' insulation batts together. The formed wire on the left has arms 248 squeezed in by had to temporarily bending horizontal arm 246 in order to spread arms 250 away from each other at the extremities. Arms 251 are bent slightly inwards and inserted into the insulation simultaneously while releasing arms 248. The formed wire to the right holds the permanent orientation of the part, and when a arms 248 are released the formed wire tries to return to this shape, pulling the insulation batts together. Because arms 251 are bent slightly inward, they will pull the bottom of the insulation together as well as the top of the insulation because the slight bend takes into consideration spring-back of the formed wire, and will not be easily pulled out. Horizontal arm 246 and arms 248 may be equally shown as one or more circular coils (not shown) to provide the same effect.

FIG. 20 shows an alternate 'stitching' formed wire BI with arm 246 positioned perpendicular to arms 248 which are positioned at an angle to arms 250 which overlap each other at a point along their lengths. Arms 251 with impaling ends 252 are positioned somewhat perpendicular to arms 250, however slightly bent inwards. Formed wire BI is intended to be pushed open, have impaling arms 252 and arms 251 inserted into 2 pieces of adjacent insulation 86 and then released in order to spring the insulation 86 parts close together.

Figure 21:
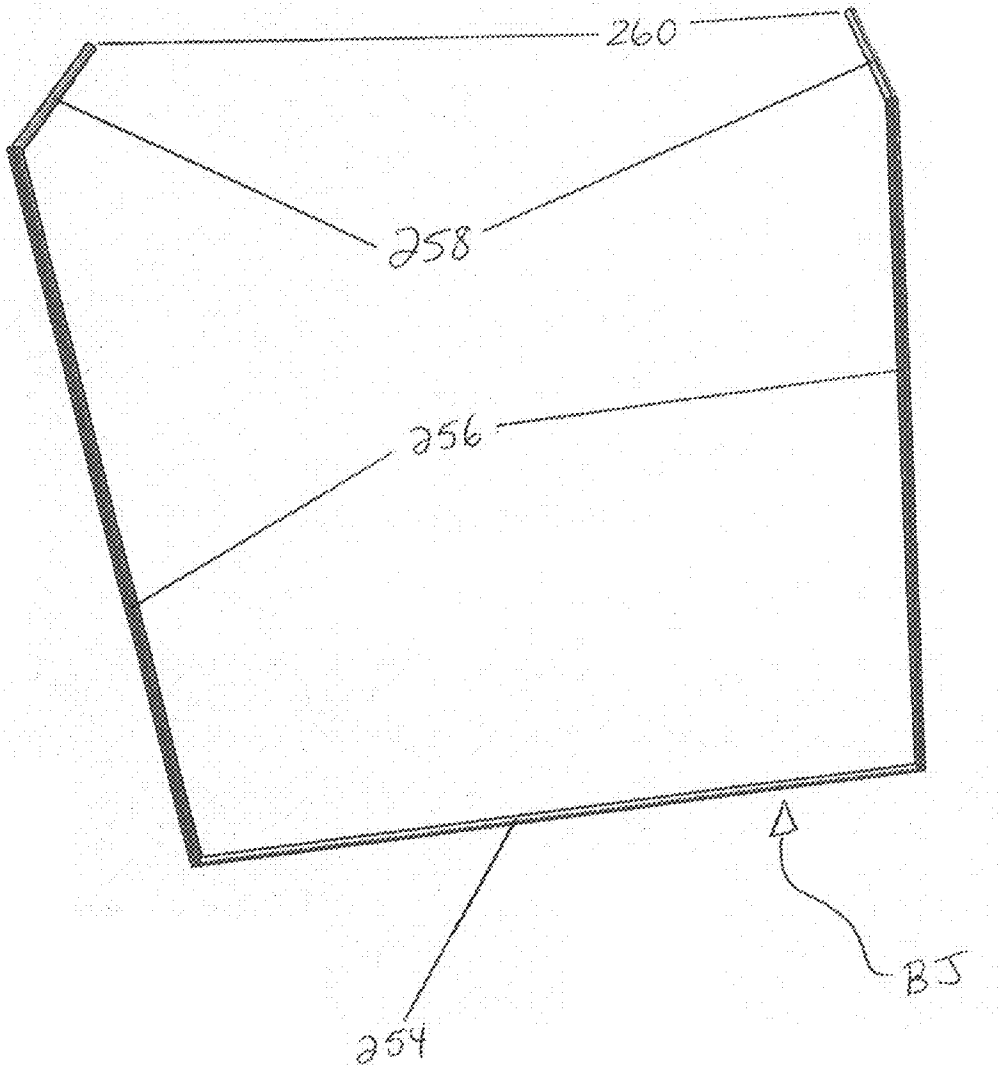
FIG. 21 shows in 3D an isometric plan view of a 'stitching' formed wire of the preferred embodiment. Arms 256 are separated near arms 258 creating tension within arms 258 as well as in arm 254 due to bending them. Arms 258 are slightly bent inwards in order to pull the bottom of the insulation together as well as the top of the insulation because the slight bend takes into consideration spring-back of the formed wire.

FIG. 21 shows the preferred embodiment of a 'stitching' formed wire BJ with arm 254 being positioned perpendicular to arms 256 which are in turn somewhat perpendicular to arms with impaling ends 260. Arms 258 are bent slightly inwards so that when arms 256 are bent away from each other they create spring back. When arms 258 with impaling ends 260 are fully inserted into 2 adjacent pieces of insulation 86, the arms 256 are released and they spring back causing the insulation 86 pieces to be tightly positioned adjacent to each other.

While the foregoing embodiments of the application have been set forth in considerable particularity for the purposes of making a complete disclosure of the invention, it may be apparent to those of skill in the art that numerous changes may be made in such details without departing from the spirit and principles of the application. Additionally, combinations and interchangeability or inter-use of components and embodiments should be considered apparent to the spirit and principles of the application, and in which all terms are meant in their broadest, reasonable sense unless otherwise indicated. Any headings utilized within the description are for convenience only and have no legal or limiting effect.

What is claimed is:

1. A device for attaching insulation to other insulation, comprising formed wires having:

an insertion arm terminates perpendicularly into an arm which terminates perpendicularly into a radiused arm which terminates at an impaling end, wherein said formed wires are configured to combine smaller pieces of insulation to larger pieces of insulation; and an anti-reversal clip attached to said impaling end, said anti-reversal clip is adapted to prevent said impaling end from backing out.

* * * * *